US010143301B2

(12) United States Patent
Summerville

(10) Patent No.: US 10,143,301 B2
(45) Date of Patent: Dec. 4, 2018

(54) CABINET CONVERSION PANELS

(76) Inventor: Anita Brochette Summerville, Maple Grove, MN (US)

( * ) Notice: Subject to any disclaimer, the term of this patent is extended or adjusted under 35 U.S.C. 154(b) by 662 days.

(21) Appl. No.: 13/011,767

(22) Filed: Jan. 21, 2011

(65) Prior Publication Data

US 2012/0187813 A1 Jul. 26, 2012

(51) Int. Cl.

| | |
|---|---|
| ***A47G 29/00*** | (2006.01) |
| ***A47B 73/00*** | (2006.01) |
| ***A47B 77/14*** | (2006.01) |
| ***A47B 81/04*** | (2006.01) |

(52) U.S. Cl.

CPC ..... *A47B 73/00* (2013.01); *A47B 77/14* (2013.01); *A47B 81/04* (2013.01)

(58) Field of Classification Search

CPC ..... A47B 7/30; A47B 47/03; A47B 73/006; A47B 81/04; A47B 77/14; A47F 7/28

USPC ..... 211/13.1, 71.01, 74–77, 184, 72, 73, 211/60.1; 312/351, 128, 265.1–265.6; 52/660, 663–668

See application file for complete search history.

(56) References Cited

U.S. PATENT DOCUMENTS

| | | | | | |
|---|---|---|---|---|---|
| 75,098 | A * | 3/1868 | Williams | 52/660 | |
| 343,958 | A * | 6/1886 | Kinney | 52/665 | |
| 378,415 | A * | 2/1888 | Burkhardt | 52/665 | |
| 402,847 | A * | 5/1889 | McDonald | 52/665 | |
| 510,185 | A * | 12/1893 | Mitchell | A47L 19/04 211/41.3 | |
| 529,719 | A * | 11/1894 | Eils | 52/663 | |
| 609,009 | A * | 8/1898 | Carrington | 472/58 | |

(Continued)

FOREIGN PATENT DOCUMENTS

| | | |
|---|---|---|
| EP | 0666042 A1 | 8/1995 |
| EP | 0777990 A2 | 6/1997 |

OTHER PUBLICATIONS

Winecabinets.com, a division of Vino Cellars. "Kitchen cabinet wine racks," 2010 [retrieved on Sep. 17, 2012]. Retrieved from the Internet: <URL: http://www.winecabinets.com/v/products/kitchen-cabinet-wine-racks.html>.

(Continued)

*Primary Examiner* — Jonathan Liu
*Assistant Examiner* — Devin K Barnett
(74) *Attorney, Agent, or Firm* — Fish & Richardson P.C.

(57) ABSTRACT

A panel for converting a cabinet (20) into unit specific storage. The cabinet conversion panel comprises a plurality of posts (21), rods (22) and or shelves (23) extending in a vertical, diagonal and or horizontal direction connected and fastened to create interconnected or intersecting lattice, square, rectangular, diamond, circular, herringbone, octagonal, triangular or other geometrical patterns with a frame surrounding and fastened to the operably connected partitions to complete the panel. The cabinet conversion panel also comprises insertable coasters (34-41) and interchangeable inserts (7-9, 14-15, 17, 47-48 and 50-51) to change the function, capacity and design of the panels. The cabinet conversion panel is sized for installation into standard cabinets (20). The panel is adapted so that when two or more of the panels are inserted into a cabinet (20), they will vertically support and hold various types of units including but not limited to wine bottles (26), plates (28), cups (29), dishware, stemware (27), shelves (23) and or other items.

21 Claims, 28 Drawing Sheets

(56) References Cited

U.S. PATENT DOCUMENTS 701,588 A * 6/1902 Liebau ..... 256/19
714,350 A * 11/1902 Youngblood ..... 52/238.1
917,354 A * 4/1909 Phillips ..... 52/666
1,270,095 A * 6/1918 Baehr ..... 211/74
1,784,895 A * 12/1930 Dunker ..... 52/663
1,833,081 A * 11/1931 Kilmer ..... 217/36
1,859,664 A * 5/1932 Fulda ..... 404/134
1,940,862 A * 12/1933 Henderson ..... 52/664
1,994,930 A * 3/1935 Tommerup ..... 404/134
2,622,741 A * 12/1952 Bamert ..... 211/74
2,860,740 A * 11/1958 Holland et al. ..... 428/60
2,995,224 A * 8/1961 Butler et al. ..... 52/663
3,004,642 A * 10/1961 Hallock ..... 52/663
3,045,325 A * 7/1962 Mabie ..... 29/897.34
3,070,198 A * 12/1962 Haskell ..... 428/116
3,077,961 A * 2/1963 Deicke ..... 52/663
3,200,489 A * 8/1965 Keeleric ..... 228/118
3,222,832 A * 12/1965 Presunka ..... 52/207
3,307,316 A * 3/1967 Gray ..... 52/507
3,379,315 A * 4/1968 Broadwin ..... 211/72
3,398,497 A * 8/1968 Hellmich et al. ..... 52/665
3,428,385 A * 2/1969 Scott ..... 312/265.3
D219,058 S * 10/1970 Kaezur ..... D7/701
3,546,844 A * 12/1970 Schwartz ..... 52/581
3,563,834 A * 2/1971 Vidan ..... 428/52
3,600,792 A * 8/1971 Valluy et al. ..... 29/428
3,672,111 A * 6/1972 Deck et al. ..... 52/666
3,683,581 A * 8/1972 Yamaso ..... 52/666
3,729,891 A * 5/1973 Olsen ..... 52/663
3,808,084 A * 4/1974 Doty ..... 248/346.11
D236,411 S * 8/1975 Homey ..... D6/683
4,009,796 A * 3/1977 Schmidt ..... 220/668
4,023,681 A * 5/1977 Plant ..... 211/74
4,093,076 A * 6/1978 Newton ..... 211/74
4,095,698 A 6/1978 Wright
4,095,858 A * 6/1978 Hopf ..... 312/198
D248,911 S * 8/1978 Handel ..... D6/664.1
4,270,662 A * 6/1981 Gonzalez ..... 211/74
D260,063 S * 8/1981 Aylor ..... D6/407
4,282,695 A * 8/1981 Lew ..... 52/668
D268,463 S * 4/1983 Olson ..... D7/708
4,408,741 A * 10/1983 Mimura et al. ..... 248/68.1
4,409,770 A * 10/1983 Kawaguchi et al. ..... 52/666
D272,699 S * 2/1984 Godfrey ..... D7/701
4,474,297 A 10/1984 Zucker
4,485,930 A 12/1984 Savelkouls
4,566,598 A * 1/1986 Fors ..... A47F 7/0246 211/169
4,700,849 A * 10/1987 Wagner ..... 211/41.2
4,715,503 A * 12/1987 Johnson ..... 211/74
4,795,038 A * 1/1989 Johnson ..... 211/74
4,947,999 A * 8/1990 Warp ..... A47B 96/00 108/901
4,991,726 A 2/1991 Johnson
D317,991 S * 7/1991 Wightman ..... D6/683.1
5,036,989 A * 8/1991 Carilli ..... 211/74
5,222,343 A * 6/1993 Anderson ..... E06B 1/342 52/211
5,241,799 A * 9/1993 Jahn ..... E04B 9/345 52/28
D346,290 S * 4/1994 Cifra ..... D19/90
5,348,220 A * 9/1994 Setteducati ..... A45C 1/12 232/1 D
D358,509 S * 5/1995 Klein ..... D6/675.2
5,465,891 A * 11/1995 Bridges ..... 224/566
D365,949 S * 1/1996 Klein ..... D6/675.1
5,499,716 A * 3/1996 Gardner ..... B65D 71/70 206/499
5,588,725 A * 12/1996 Frank ..... A47B 81/00 312/204
5,617,960 A * 4/1997 Bishop ..... 211/60.1
5,639,150 A * 6/1997 Anderson et al. ..... 312/265.3
5,657,605 A * 8/1997 Sidney ..... 52/664
5,673,985 A * 10/1997 Mitchell ..... 312/265.3
5,743,438 A 4/1998 Sokolnicki
5,833,512 A * 11/1998 Nicola ..... 446/114
5,921,647 A * 7/1999 Schneider et al. ..... 312/265.3
5,947,305 A * 9/1999 Lin ..... 211/74
D414,991 S * 10/1999 Brown ..... D7/701
5,971,167 A * 10/1999 Finbow ..... 211/71.01
6,026,983 A * 2/2000 Graham ..... A47G 23/0216 220/738
6,039,191 A 3/2000 Purnell
6,042,207 A * 3/2000 Crosby et al. ..... 312/351
6,082,069 A * 7/2000 Chennaux ..... 52/648.1
6,173,845 B1 1/2001 Higgins et al.
6,200,664 B1 * 3/2001 Figge et al. ..... 428/178
6,272,801 B1 * 8/2001 Suh ..... E06B 3/5892 49/505
6,283,566 B1 9/2001 Doces
6,345,483 B1 * 2/2002 Clark ..... 52/649.1
6,357,607 B1 3/2002 Wu
6,422,406 B1 * 7/2002 Kessel ..... A47B 47/03 211/181.1
6,482,500 B1 * 11/2002 Diginosa ..... E04F 19/02 428/121
6,562,430 B1 * 5/2003 Leon ..... B28C 5/40 156/297
D476,825 S * 7/2003 Adams ..... D6/662.1
D491,744 S * 6/2004 Harwanko ..... D6/657
6,754,144 B1 * 6/2004 Fushimi et al. ..... 369/44.25
D498,368 S * 11/2004 Harwanko ..... D6/657
6,840,592 B2 * 1/2005 Kalieta et al. ..... 312/326
6,843,381 B2 1/2005 Wu
D504,250 S * 4/2005 Rozenboom ..... D6/662.1
7,159,735 B2 * 1/2007 Morse ..... 220/529
D541,117 S * 4/2007 Schwartz ..... D7/701
7,350,647 B2 4/2008 Haller et al.
7,398,627 B2 * 7/2008 Yamamoto ..... 52/660
D586,585 S * 2/2009 Hynes ..... D6/661
D602,314 S * 10/2009 Stravitz ..... D7/701
7,712,625 B2 * 5/2010 Alger ..... 220/737
7,850,390 B2 * 12/2010 Lisbona ..... 403/382
8,011,157 B2 * 9/2011 Bartley et al. ..... 52/664
8,033,402 B1 10/2011 Bevis
8,061,538 B2 * 11/2011 Seldon ..... 211/74
8,132,871 B1 3/2012 Caruso
8,167,129 B2 * 5/2012 Hatcher ..... 206/565
D661,952 S * 6/2012 Tiemann ..... D7/590
8,292,093 B2 * 10/2012 Fan ..... 211/26
D672,587 S * 12/2012 Puksta ..... D6/705
8,376,304 B2 * 2/2013 Almada ..... 248/346.11
8,609,226 B2 * 12/2013 Herron, III ..... 428/166
8,763,834 B2 * 7/2014 Skovira ..... B65D 21/083 220/23.4
9,217,519 B2 * 12/2015 Masters ..... F16L 3/22
9,320,355 B2 * 4/2016 Lee ..... A47B 73/006
9,464,735 B2 * 10/2016 Masters ..... F16L 3/2235
D801,728 S * 11/2017 Reyes ..... D6/660
2001/0000557 A1 * 5/2001 Cantley ..... 52/666
2001/0025824 A1 * 10/2001 Olivero ..... 211/74
2001/0034990 A1 * 11/2001 Reichert ..... 52/456
2002/0017839 A1 * 2/2002 Wei ..... 312/265.1
2003/0080073 A1 * 5/2003 Huang et al. ..... 211/40
2003/0178381 A1 * 9/2003 Liang ..... 211/74
2004/0083662 A1 * 5/2004 McGlinchy ..... 52/204.61
2004/0187417 A1 * 9/2004 Thomas ..... B44C 5/00 52/311.1
2005/0011843 A1 * 1/2005 Dagan ..... 211/74
2005/0166856 A1 * 8/2005 Kaneko ..... A01K 1/0107 119/169
2005/0174020 A1 * 8/2005 Francisquini ..... 312/265.3
2006/0162272 A1 * 7/2006 Phillips et al. ..... 52/660
2007/0000195 A1 * 1/2007 Garces et al. ..... 52/204.61
2007/0017884 A1 * 1/2007 Yang ..... 211/74
2007/0108144 A1 * 5/2007 Flick ..... 211/74
2007/0108145 A1 * 5/2007 Milardo et al. ..... 211/74
2007/0210022 A1 * 9/2007 Bianchini ..... 211/75
2008/0104923 A1 * 5/2008 Boxhorn et al. ..... 52/663
2009/0139890 A1 * 6/2009 Hatcher ..... 206/457
2009/0152222 A1 6/2009 Seldon
2009/0173034 A1 * 7/2009 Woolston ..... 52/660

(56) References Cited

U.S. PATENT DOCUMENTS

| | | | | |
|---|---|---|---|---|
| 2009/0289018 | A1* | 11/2009 | Yang | 211/74 |
| 2010/0006523 | A1 | 1/2010 | Hogeback | |
| 2011/0036791 | A1* | 2/2011 | Huang | 211/74 |
| 2011/0049068 | A1* | 3/2011 | Potter | 211/69.1 |
| 2011/0146581 | A1* | 6/2011 | Sasano | A01K 1/0107 119/171 |
| 2011/0278247 | A1* | 11/2011 | Moffly | 211/74 |
| 2012/0137627 | A1* | 6/2012 | Vemuri | 52/665 |
| 2014/0021320 | A1* | 1/2014 | Rudnick | 248/346.11 |
| 2014/0053494 | A1* | 2/2014 | Russell | 52/660 |
| 2014/0354129 | A1* | 12/2014 | Skovira | 312/265.2 |

OTHER PUBLICATIONS

Powers, Deb. "How to Build a Wine Rack in a Kitchen Cabinet," eHow, 1999 [retrieved on Sep. 17, 2012]. Retrieved from the Internet: <URL: http://www.ehow.com/how_4674715_build-wine-rack-kitchen-cabinet.html >.

Omega National Russian River Cabinet Mount Wine Racks. Datasheet [online). [Retrieved on Sep. 17, 2012.] Retrieved from the Internet: <URL: http://www.kitchensource.com/wine-racks/na-ws100ouf1.htm>.

Martha Stewart Living, Nov. 2002 [retrieved on Sep. 17, 2012]. Retrieved from the Internet: <URL: http://www.marthastewart.com/272322/compact-wine-rack?czone=home/smart-savings-cnt/save-space&center=277003&gallery=274959&slide=272322>.

Omega Hardwood Products National Products' online website at: http://www.eclectic-ware.com/Eclectic-ware/Omega/wine_rack_lattice/wine_rack_lattice.html shows an example of prior art wine lattice (Fig. 39 on the Drawings included with this Patent Application).

Omega Hardwood Products National Products' online website at: http://www.eclectic-ware.com/Eclectic-ware/Omega/stemware_holders/stemware_holders.html shows an example of prior stemware holders (Figs. 46-47 on the Drawings included with this Patent Application).

Omega Hardwood Products National Products' online website at: http://www.eclectic-ware.com/Eclectic-ware/Omega/china_plate_display/china_plate_display.html shows an example of prior art plate rack (Fig. 44 on the Drawings included with this Patent Application).

Rockler Woodworking and Hardware's online website at: http://www.rockler.com/tech/RTD10000512AA.pdf shows an example of prior art wine lattice. (Fig. 40 on the Drawings included with this Patent Application).

Hafele's online website at: http://www.kitchensource.com/cabinet-organizers/ha-541.98.160b-l.htm shows an example of prior art plate rack. (Fig. 45 on the Drawings included with this Patent Application).

Maple Craft USA's website at: http://www.maplecraftusa.com/HTMLcabstorage/popLATTICE.html shows examples of prior art wine lattice. (Figs. 41-43 on the Drawinings included with this Patent Application).

Woodworker's Hardware's website at: http://wwhardware.com/showimage.cfm?type=spec&productid=NPSR%2018%20ALD shows an example of prior art stemware molding. (Fig. 48 on the Drawings included with this Patent Application).

European Search Report for application No. 12736533.6 dated May 27, 2014. (6 pages).

First Office Action received in connection with Chinese Application No. 201280006108.0, dated Jan. 7, 2015 with English translation.

Second Office Action dated Jul. 29, 2015 in connection with Chinese Patent Application No. 2012800061080, including English translation.

* cited by examiner

CABINET CONVERSION PANELS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISC APPENDIX

Not Applicable.

BACKGROUND OF THE INVENTION

A. Field of Invention

This invention relates to a new and improved cabinet organizing and storage apparatus. Specifically, this invention when installed as directed, converts cabinets into compartmentalized wine bottle, dishware and or stemware storage including but not limited to wine racks, plate racks, stemware hangers and or shelving for other items.

Most embodiments of this invention are new including but not limited to: A) All non-lattice style wine bottle storage panels; B) Construction method; C) Panel Function (i.e. storage capacity and types); D) All panel designs; E) Frame-encased panels; F) Interchangeable sections; G) Method of installation of the panels; H) Combination panels (i.e. plate and bottle panels); and I) Insertable coasters.

The new embodiments are apparent when comparing FIGS. 41-50 (examples of prior art) with the cabinet conversion panels as shown in FIGS. 1A-2C, 5A-8, 14A-23 and 28-40 which are this inventor's new inventions in this art.

Some embodiments of this invention are improvements on traditional cabinet storage apparatuses including wine lattice and plate racks.

The improvements of prior art for lattice style wine bottle storage and typical plate racks are apparent when comparing FIGS. 41-50 (examples of prior art) with the cabinet conversion panels shown in FIGS. 3-4C, 9A-13B and 24-27 (this inventor's improvements of the prior art).

B. Description of Prior Art

Typically, wine bottle lattice, plate racks and stemware molding are either pre-installed commercially or sold in limited sizes.

Cabinets may be purchased with pre-installed wine lattice, plate racks and stemware molding. This option is typically chosen by when replacing an entire set of cabinets.

A second option for the consumer is to purchase the wine lattice, plate racks and stemware molding, then measure, cut and install the wine lattice, plate racks and stemware molding.

Wine bottle storage for cabinets is available in one basic lattice style as shown in FIGS. 41-50. The non-intersecting posts are unattached and unframed.

Plate racks for cabinets are available in one basic style as shown in FIGS. 46-47.

Stemware molding for cabinets is available in one basic style as shown in FIGS. 48-50. The molding is typically sold in individual pieces which are unattached.

C. Problems in Prior Art

The pre-installed and uninstalled wine lattice, plate racks and stemware molding are standard in sizes, materials and almost indistinguishable from one brand to the next. Both, the pre-installed and the purchase and install methods are permanent with no interchangeable sections to change the function and design of the storage component.

If the consumer chooses to purchase cabinets with wine lattice, plate racks and or stemware molding pre-installed, it can be an expensive option at 2-7 times the cost of a standard cabinet.

To install the uninstalled wine lattice and plate racks, the installer must cut-to-fit the wine lattice and plate racks, then construct and fasten blocking in the front and back of the wine lattice and plate racks to stabilize them.

To install the uninstalled stemware molding, the installer must utilize nails or screws to attach each piece of molding to the cabinet or cut-to-fit boards with the molding pre-attached.

For the layperson with limited carpentry skills and or limited tools, adapting and installing the wine lattice, plate racks and stemware molding can be expensive, time consuming and inconvenient, to say the least. Moreover, if the installer errantly cuts the product too short, they have to absorb the expense of purchasing more.

D. Improvements

This Inventor, while seeking to functionally and aesthetically improve and update cabinets found only difficult to install, inconvenient, expensive and same-look options. The inventor finds there is a need and demand for this invention which overcomes problems found in the prior art construction, installation, interchangeability, combination storage features, storage capacity, strength, design and accessories.

In prior art the wine storage apparatus is constructed in the form of a lattice pattern whereas in this invention, the wine storage apparatuses are constructed in various configurations including but not limited to herringbone, diagonal ladder, square, circular and other patterns. The new invention configurations are different from the prior art in construction, design and function.

This invention comprises cabinet conversion panels (constructed to fit standard cabinet sizes) which are easily installed by laypersons with limited carpentry skills and few, if any tools. Prior inventions in this art offer either expensive commercially pre-installed options or complicated consumer installation options.

This invention comprises cabinet conversion panels with various designs and interchangeable sections so that the consumer may readily change the function and look of their cabinets. Prior inventions in this art offer one design for each type of storage and do not offer any interchangeable sections.

This invention comprises cabinet conversion panels with combination functions including but not limited to wine bottle storage and plate racks; shelves and plate racks; wine bottle and stemware storage; and wine bottles and shelves.

None of the previously existing wine, plate and stemware storage inventions offer combination storage options.

This invention comprises coasters to insert in empty wine bottle compartments. Prior art inventions offer no coasters or accessories to cover or decorate empty wine bottle compartments.

BRIEF SUMMARY OF THE INVENTION

In light of the above and according to one broad aspect of one embodiment of the invention, disclosed herein is a cabinet conversion panel to convert cabinet (20) space into wine bottle (26), dishware and or stemware storage.

A cabinet conversion panel comprises a plurality of posts (21), rods (22) and or shelves (23) extending in a vertical, diagonal and or horizontal direction, which create interconnected or intersecting lattice, square, diamond, herringbone, circular, octagonal, triangle or other geometrical patterns with partitioned openings, adjustable shelves (23) and inserts to accommodate the storage of wine bottles (26), dishware, stemware and or other items.

In every cabinet conversion panel, the plurality of non-intersecting post ends, rod ends and shelf ends extend and are connected and fastened to a frame, surround the panel.

Every cabinet conversion panel comprising wine bottle openings (30) also comprise and accommodate coordinating coasters which fit into and cover the empty wine bottle openings (30).

The coordinating coasters comprise a plurality of posts (21) connected and fastened in geometrical patterns fastened to form a square or rectangle which may be inserted into the partitioned wine bottle openings (30) and which may be removed for use as a traditional coaster.

The cabinet conversion panel is configured so that when two or more of the cabinet conversion panels are inserted into a cabinet (20), they will vertically diagonally and or horizontally support and hold items including but not limited to wine bottles (26), dishware, stemware and shelves (23).

Plates (28) and saucers can be stored vertically between vertical posts (21) or rods (22), or horizontally on shelves (23). Wine bottles (26) can be stored horizontally in open squares or vertically on shelves (23). Cups (29) can be hung from hooks attached to the bottoms of shelves (23) or stored on shelves (23). Wine glasses (27) can be stored on shelves (23) or suspended from wine molding shelves (23). Stemware molding shelves (23) and shelves (23) with hooks may be installed inside cabinets (20) or underneath cabinets (20).

Various configurations of panels may be formed using embodiments of the present invention. Some configurations of this invention offer interchangeable inserts for sections of the invention which allows changes to the function and look of the cabinet conversion panels.

The above and other objectives, features, and advantages of this invention will be apparent from the following Detailed Description of the Invention when considered in connection with the accompanying drawings.

BRIEF DESCRIPTION OF THE SEVERAL VIEWS OF THE DRAWINGS

FIG. 23 is a front view of all eight examples of the insertable coasters (FIG. 15-22) installed in the partitioned wine bottle openings of an interchangeable insert (FIG. 13A).

DETAILED DESCRIPTION OF THE INVENTION

Figure 1A:
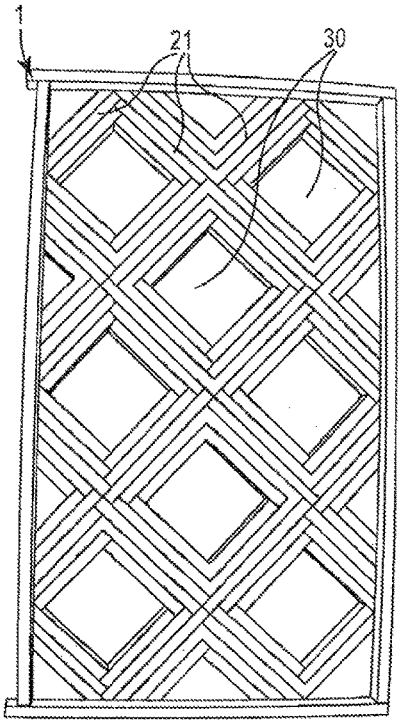
FIG. 1A is a frontal perspective view of an example of the cabinet conversion panel, in accordance with an embodiment of the present invention wherein posts (21) are connected and fastened in a multilayered square style pattern to form partitioned openings (30) to accommodate the storage of wine bottles (26).
Figure 1B:
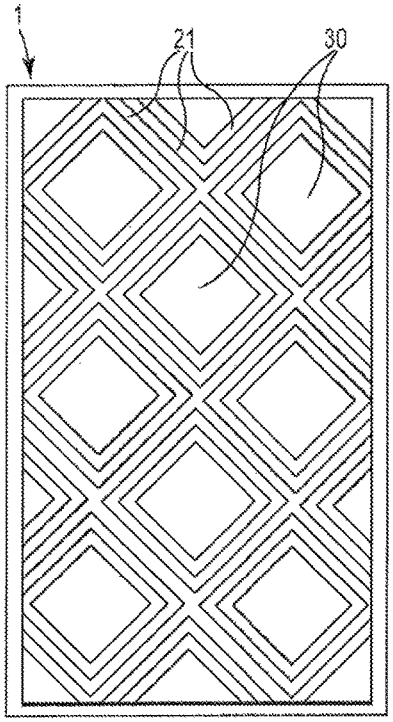
FIG. 1B is a schematic frontal perspective view of an example of the cabinet conversion panel in FIG. 1A.
Figure 2A:
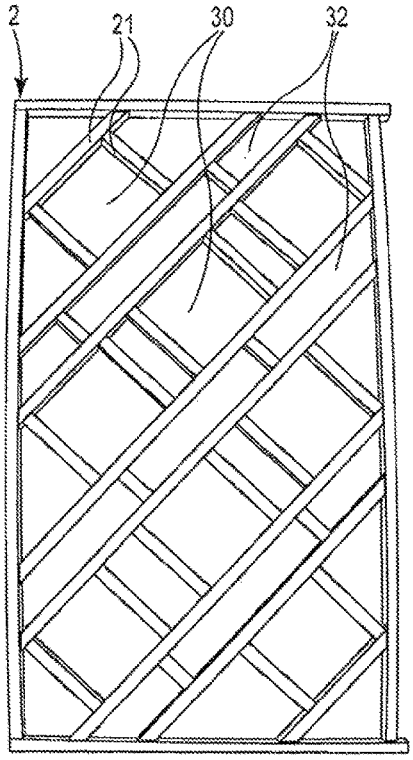
FIG. 2A is a frontal perspective view of an example of the cabinet conversion panel, in accordance with an embodiment of the present invention wherein posts (21) are connected and fastened in a diagonal ladder style pattern to form partitioned openings (30) to accommodate the storage of wine bottles (26).
Figure 2B:
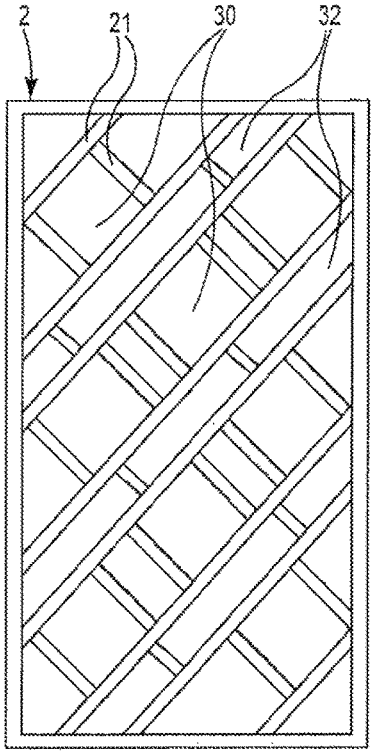
FIG. 2B is a schematic frontal perspective view of the example of the cabinet conversion panel in FIG. 2A.
Figure 2C:
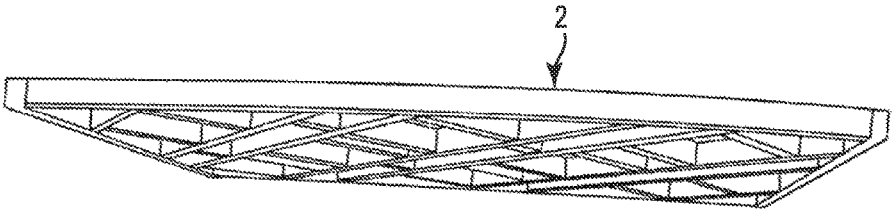
FIG. 2C is a top side perspective view of the example of the cabinet conversion panel in FIG. 2A.
Figure 3:
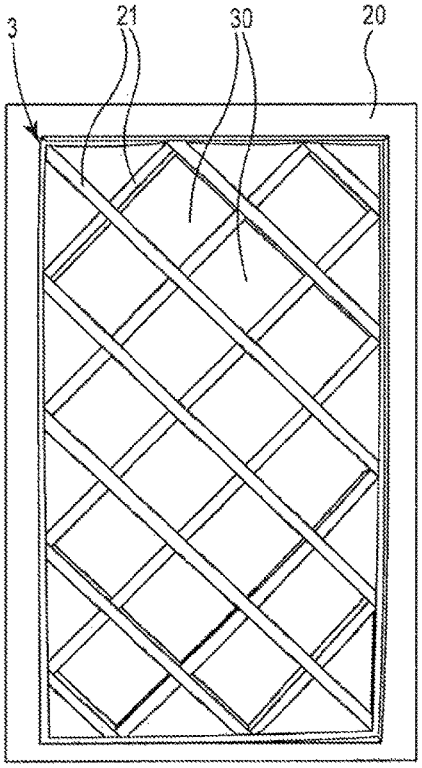
FIG. 3 is a frontal perspective view of an example of the cabinet conversion panel, in accordance with an embodiment of the present invention wherein posts (21) are connected and fastened in a lattice style pattern to form partitioned openings (30) to accommodate the storage of wine bottles (26). This panel is shown installed in a cabinet (20).
Figure 22:
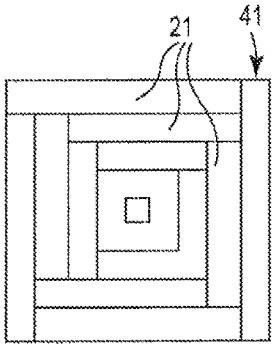
FIG. 22 is a front view of an example of an eighth type of insertable coaster wherein posts are connected and fastened to form a square pattern.
Figure 24:
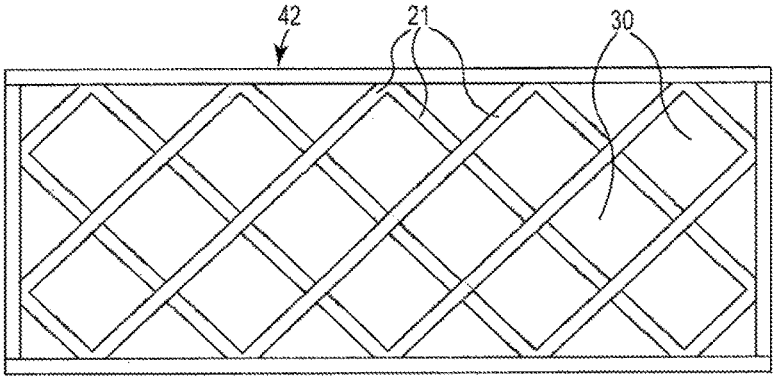
FIG. 24 is a schematic front view of an example of the cabinet conversion panel, in accordance with an embodiment of the present invention wherein posts (21) are connected and fastened in a lattice style pattern to form partitioned wine bottle openings (30).
Figure 25:
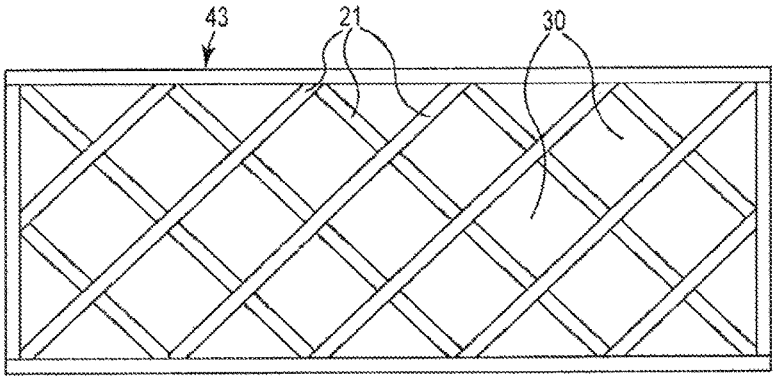
FIG. 25 is a schematic front view of an example of the cabinet conversion panel, in accordance with an embodiment of the present invention wherein posts (21) are connected and fastened in a lattice style pattern to form partitioned wine bottle openings (30). This example is distinguishable from the cabinet conversion panel in FIG. 24 as they are installed in the frame at different attachment points resulting in different number or partitioned openings (30).
Figure 26:
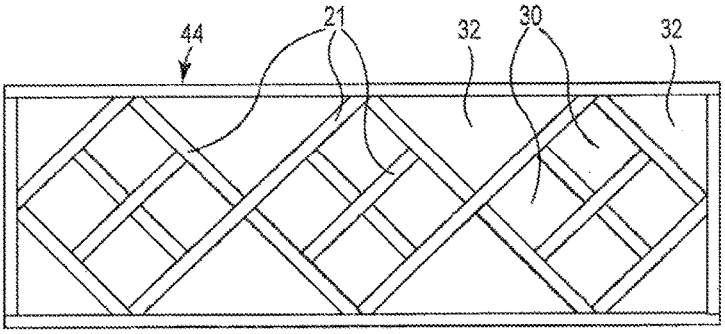
FIG. 26 is a schematic front view of an example of the cabinet conversion panel, in accordance with an embodiment of the present invention wherein posts (21) are connected and fastened into 3, 4-part diamond style pattern to form partitioned wine bottle openings (30).

A cabinet conversion panel comprises a plurality of posts (21), rods (22) and or shelves (23) extending in a vertical, diagonal and or horizontal direction, connected and fastened in lattice patterns as shown in FIGS. 3, 24 and 25; square patterns as shown in FIGS. 1A and 1B; diamond patterns as shown in FIG. 26; herringbone patterns as shown in FIG. 22; diagonal ladder patterns as shown in FIGS. 2A and 2B; triangle or other geometrical patterns with partitioned openings as shown in FIGS. 5A, 5B, 6A and 6B; adjustable shelves (23) as shown in FIGS. 6A, 6B, 11, 14B and 27; interchangeable inserts as shown in FIGS. 7, 8, 13A-13C, 14A, 14B and 30-33; and coordinating coasters as shown in FIGS. 15-22.

In each cabinet conversion panel, the plurality of nonintersecting post ends, rod ends and shelf ends extend and are connected and fastened to a frame which surround the panel.

Every cabinet conversion panel comprising wine bottle openings (30), accommodate coordinating coasters (34-41) which fit into and cover the empty wine bottle openings (30).

The coordinating coasters (34-41) shown in FIGS. 15-22 comprise a plurality of posts (21) which are connected and fastened in geometrical patterns to form a square or rectangle which may be inserted in the partitioned openings (30) for wine bottles (26) and which may be conveniently removed for use as a traditional coaster on which drinking containers are placed.

The cabinet conversion panel is configured so that when two or more of the cabinet conversion panels are inserted into a cabinet (20), they will vertically diagonally and or horizontally support and hold items including but not limited to wine bottles (26), dishware, stemware and shelves (23). Plates (28) and saucers can be stored vertically between vertical posts (21) or rods (22), or horizontally on shelves (23). Wine bottles (26) can be stored horizontally in open squares or vertically on shelves (23). Cups (29) can be hung from hooks attached to the bottoms of shelves (23) or stored on shelves (23). Wine glasses (27) can be stored on shelves (23) or suspended from wine molding shelves (23). Stemware molding shelves (23) and shelves (23) with hooks may be installed inside cabinets (20) or underneath cabinets (20).

Figure 32:
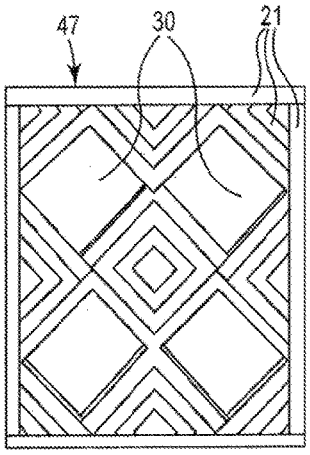
FIG. 32 is a front view of the example of the interchangeable end insert in FIG. 28.
Figure 33:
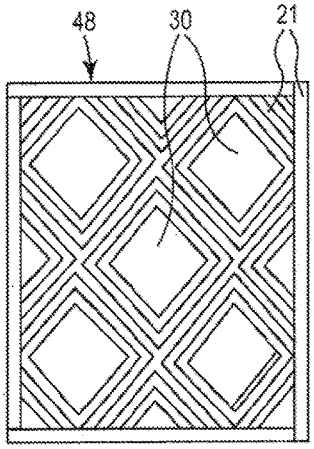
FIG. 33 is a front view of the example of the interchangeable end insert in FIG. 28.

Various configurations of cabinet conversion panels may be formed using embodiments of the present invention. Some configurations of this invention offer interchangeable center inserts (14, 15, 49 and 50) as shown in FIGS. 13A, 14A, 30 and 31 and or interchangeable end inserts (17, 46 and 47) as shown in FIGS. 28, 32 and 33 which allow changes to the function and look of the cabinet conversion panels. Some configurations of this invention offer combination storage for different items as shown in FIGS. 4A, 10A, 11, 12A, 27, 28 and 29

FIGS. 1A and 1B show an embodiment of the cabinet conversion panel (1) which comprises a plurality of posts (21) are connected and fastened together to form multilayered diagonal squares with partitioned openings in the center of each square in which wine bottles (26) may be stored. The multilayered diagonal squares are then fastened together in an intersecting pattern to form the cabinet conversion panel.

FIGS. 2A and 2B show an embodiment of the cabinet conversion panel (2) which comprises a plurality of posts (21) which are connected and fastened together in a diagonal ladder style pattern to form partitioned wine bottle openings (30). The diagonal ladders are then fastened together with small spacer posts (21) to separate the ladders from one another.

FIG. 3 shows an embodiment of the cabinet conversion panel (3) comprising a plurality of spaced posts (21) which are connected and fastened in a lattice style pattern to form partitioned wine bottle openings (30). This panel is shown installed in a cabinet (20).

Figure 4A:
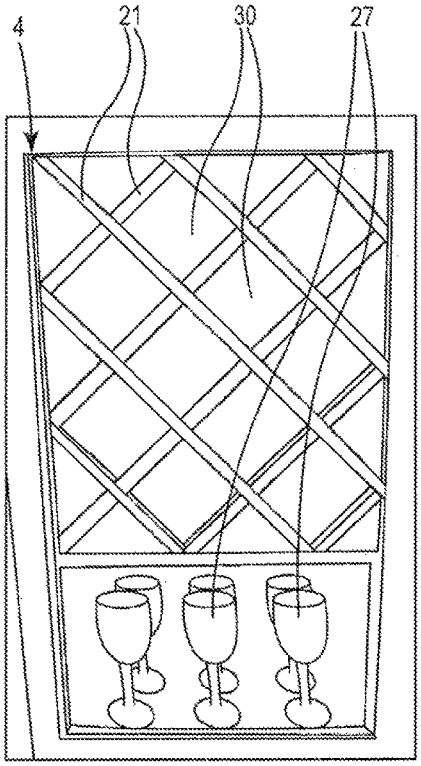
FIG. 4A is a frontal perspective view of an example of the cabinet conversion panel, in accordance with an embodiment of the present invention wherein posts (21) are connected and fastened in a lattice style pattern to form partitioned wine bottle openings (30) in approximately two-thirds of the cabinet conversion panel and wherein the upper or lower one-third of the cabinet conversion panel is divided by a shelf (23) or post to form storage for wine glasses (27) or other items above or below the lattice portion of the cabinet conversion panel. This panel is shown installed in a cabinet (20).
Figure 4B:
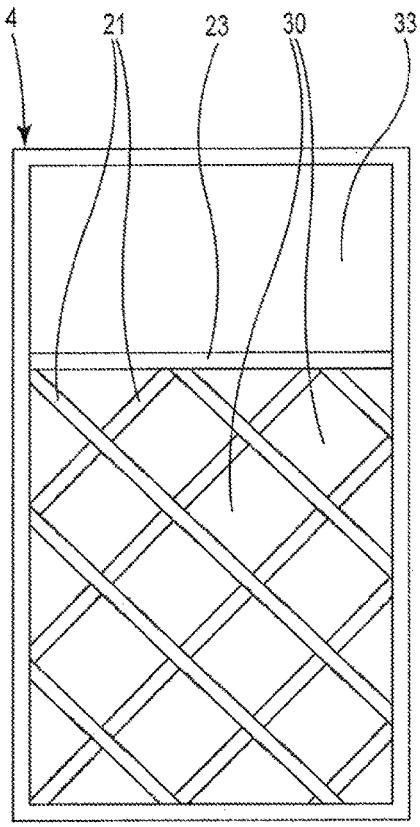
FIG. 4B is a frontal perspective view of an example of the cabinet conversion panel in FIG. 4A in accordance with an embodiment of the present invention. Whereas in FIG. 4A the cabinet conversion panel is shown installed in a cabinet (20), the cabinet conversion panel in FIG. 4B is not installed in a cabinet (20). Whereas in FIG. 4A the cabinet conversion panel is shown with the lattice portion above the wine glass or other item storage area, the cabinet conversion panel in FIG. 4B is shown with the lattice portion below the wine glass storage or other item storage shelf (23).
Figure 4C:
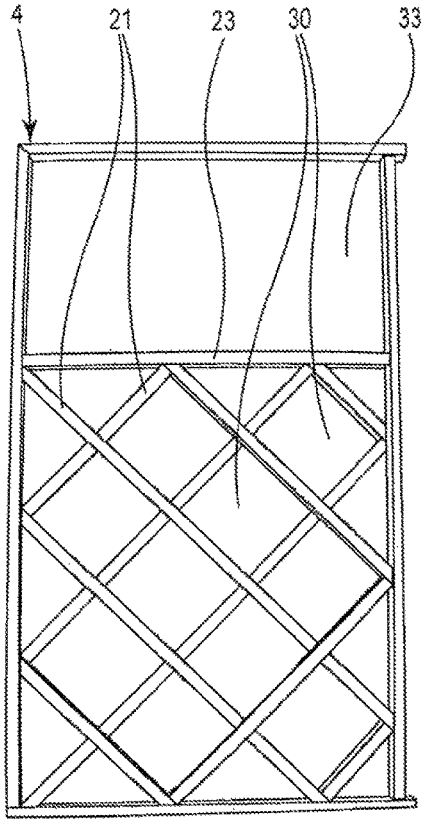
FIG. 4C is a schematic frontal perspective view of an example of the cabinet conversion panel in FIG. 4B.

FIGS. 4A, 4B and 4C show an embodiment of cabinet conversion panel (4) comprising posts (21) which are connected and fastened in a lattice style pattern to form partitioned wine bottle openings (30) in approximately two-thirds of the cabinet conversion panel; and wherein the upper or lower one-third of the cabinet conversion panel is horizontally divided by a shelf (23) or post to form storage for wine glasses (27) or other items above or below the lattice portion of the cabinet conversion panel. This panel is shown installed in a cabinet (20).

Figure 5A:
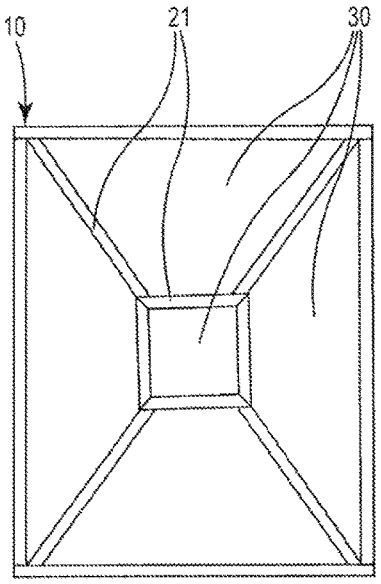
FIG. 5A is a front view of an example of the cabinet conversion panel, in accordance with an embodiment of the present invention wherein posts (21) are connected and fastened in an X with a square in the center to form partitioned wine bottle openings (30).
Figure 5B:
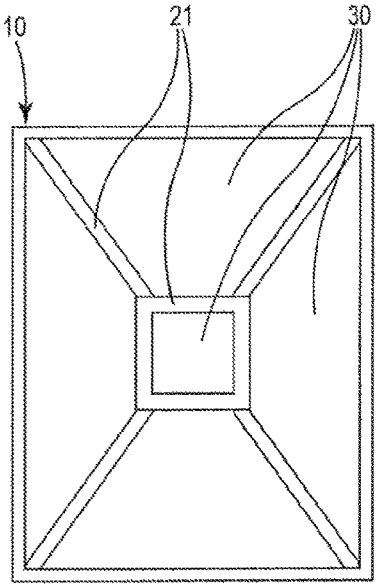
FIG. 5B is a schematic front view of an example of the cabinet conversion panel in FIG. 5A.

FIGS. 5A and 5B show an embodiment of the cabinet conversion panel (10) comprising four posts (21) or shelves (23) with one end of each post (21) or shelf (23) meeting the frame surrounding the cabinet conversion panel; and the other end of each post (21) or shelf (23) meeting a separate corner of a centered square formed by four additional posts (21) or shelves (23). The four large partitioned openings (30) accommodate the storage of wine bottles (26) stacked on top of one another. The centered square has an opening large enough to store a single wine bottle.

Figure 7:
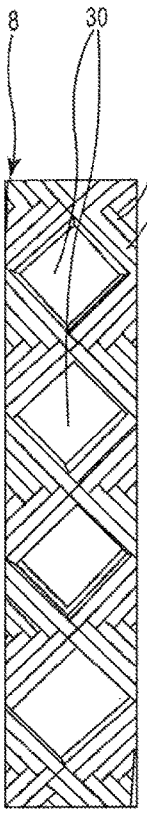
FIG. 7 is a frontal perspective view of an example of the interchangeable inserts which may be installed into the interchangeable sections of the cabinet conversion panel shown in FIG. 6A in accordance with an embodiment of the present invention.
Figure 8:
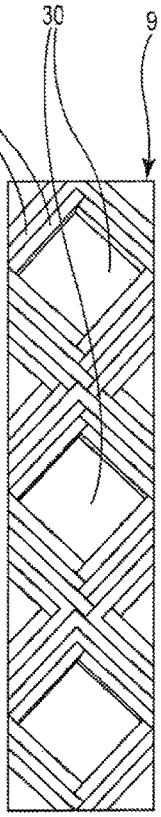
FIG. 8 is a frontal perspective view of an example of the interchangeable inserts which may be installed into the interchangeable sections of the cabinet conversion panel shown in FIG. 6A in accordance with an embodiment of the present invention.

FIGS. 6A through 6D show an embodiment of the cabinet conversion panel (6) comprising posts (21) which are connected and fastened to form three sections into which interchangeable inserts and or shelves may be installed to change the function and look of the cabinet conversion panel. The three sections accommodate shelves (23) as shown in FIG. 6A to FIG. 6D and interchangeable inserts as shown in FIGS. 7 and 8.

In another example an interchangeable insert (a smaller panel) may comprise a plurality of posts (21), rods (22) and or shelves (23) extending in a vertical, diagonal and or horizontal direction, which form partitioned openings (30) to accommodate the storage of wine bottles (26), dishware, stemware and or other items; a plurality of spaced posts (21) extending in interconnected or intersecting lattice, square, diamond, triangle or other geometrical patterns large enough to insert wine bottles (26) of varying sizes; and or adjustable shelves (23) and panels adapted to hold wine bottles (26), dishware, stemware and or other items.

FIGS. 7, 8, 13A-14B, and 30-33 are embodiments of the interchangeable inserts (7, 9, 14, 15, 17, 46, 47, 49 and 50) which may be installed into the interchangeable sections of the cabinet conversion panel. FIGS. 6A-6D, 12C-12H, 28, 29 and 35 show examples of the interchangeable inserts installed in cabinet conversion panels.

Figure 9A:
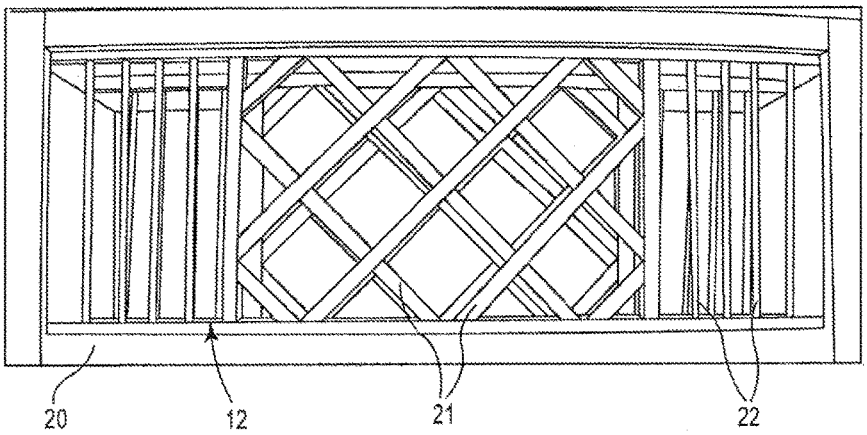
FIG. 9A is a frontal perspective view of an example of the cabinet conversion panel, in accordance with an embodiment of the present invention wherein the center section comprises posts (21) are connected and fastened in a lattice pattern to form partitioned wine bottle openings (30) and the two end sections comprise rods (22) which are connected and fastened to form partitioned vertical openings (31) in which plates (28) may be stored. This panel is shown installed in a cabinet (20).
Figure 9B:
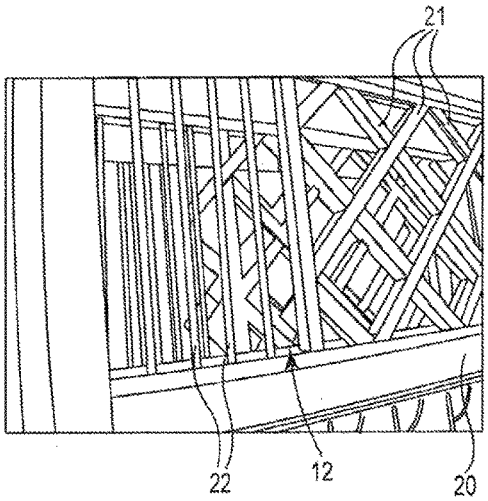
FIG. 9B is a perspective view of the example of the cabinet conversion panel in FIG. 9A.

FIGS. 9A and 9B show an embodiment of the cabinet conversion panel (12) wherein the fixed center section comprises posts (21) which are connected and fastened in a lattice pattern to form partitioned wine bottle openings (30) and the two fixed end sections comprise rods (22) which are connected and fastened to form partitioned vertical openings in which plates (28) may be stored. This panel is shown installed in a cabinet (20).

Figure 10A:
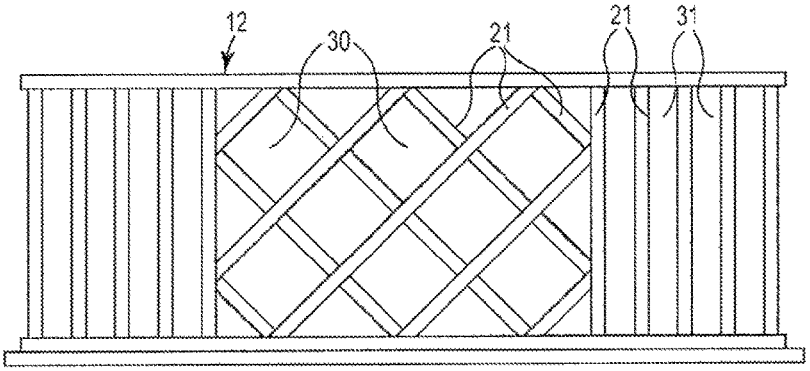
FIG. 10A is a front view of the example of the cabinet conversion panel in FIG. 9A in accordance with an embodiment of the present invention. In this example, the two end sections comprise posts (21) (instead of rods (22)) which are connected and fastened to form partitioned vertical openings (31) in which plates (28) may be stored.
Figure 10B:
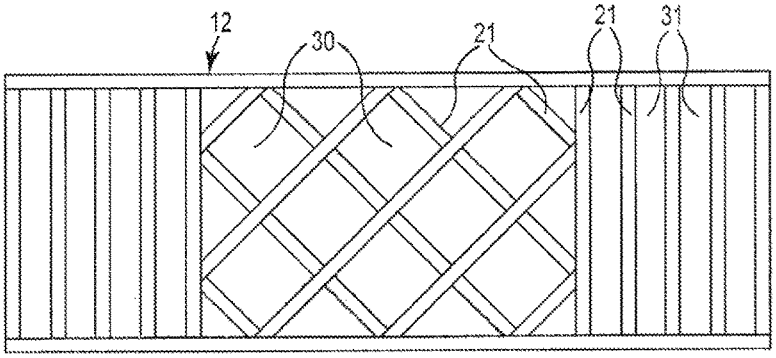
FIG. 10B is a schematic front view of an example of the cabinet conversion panel in FIG. 10A.

FIGS. 10A and 10B show an embodiment of the cabinet conversion panel (12) wherein the fixed center section comprises posts (21) are connected and fastened in a lattice pattern to form partitioned wine bottle openings (30) and the two fixed end sections comprise posts (21), instead of rods (22), which are connected and fastened to form partitioned vertical openings in which plates (28) may be stored.

Figure 11:
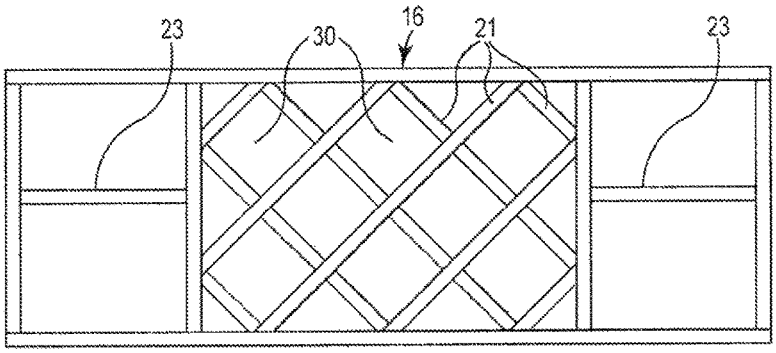
FIG. 11 is a schematic front view of an example of the cabinet conversion panel in FIG. 10A in accordance with an embodiment of the present invention which comprises a fixed center section and two interchangeable end sections in which shelves (23) or interchangeable end inserts may be installed or which may be left open for general storage. In this example, the two end sections are shown with adjustable shelves (23) installed.

FIG. 11 shows an embodiment of the cabinet conversion panel (12) in FIG. 10A which comprises posts (21) extending to in a lattice pattern to form a fixed center section and two interchangeable end sections in which shelves (23) or interchangeable end inserts may be installed or which may be left open for general storage. In this example, the two end sections are shown with adjustable shelves (23) installed.

FIGS. 12A thru 12H shows an embodiment of the cabinet conversion panel (13) comprising an interchangeable center section sections in which shelves (23) or interchangeable center inserts may be installed or which may be left open for general storage; and wherein the two fixed end sections comprise rods (22) which are connected and fastened to form partitioned vertical openings in which plates (28) may be stored.

Figure 12A:
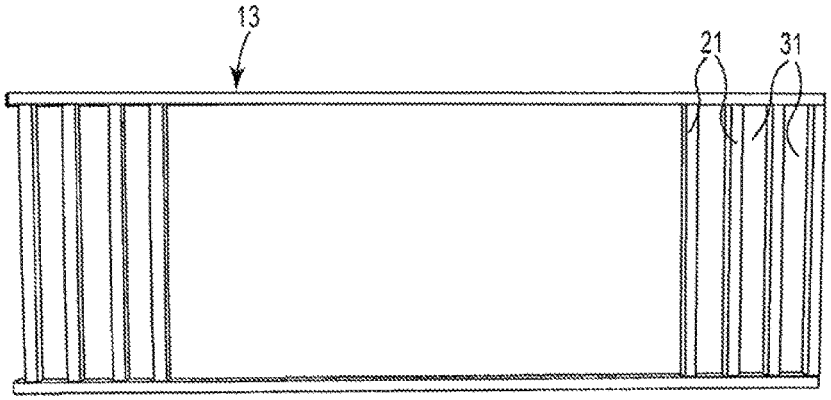
FIG. 12A is a frontal view of an example of the cabinet conversion panel, in accordance with an embodiment of the present invention wherein the center section comprises an interchangeable center section sections in which shelves (23) or interchangeable end inserts may be installed or which may be left open for general storage; and wherein the two end sections comprise rods (22) which are connected and fastened to form partitioned vertical openings (31) in which plates (28) may be stored.
Figure 12B:
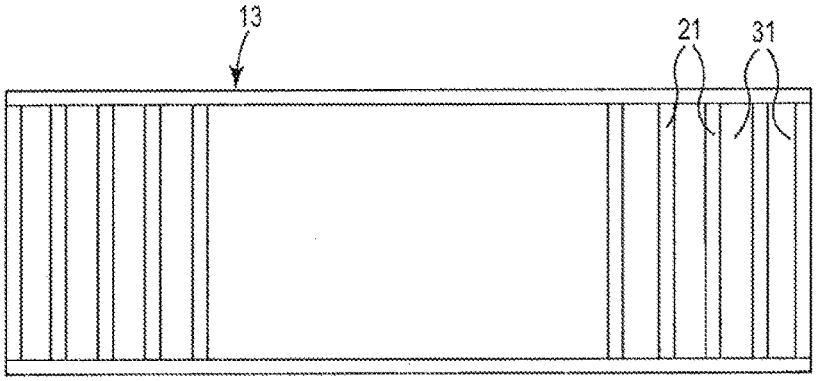
FIG. 12B is a schematic front view of the example of the cabinet conversion panel in FIG. 12A.
Figure 12C:
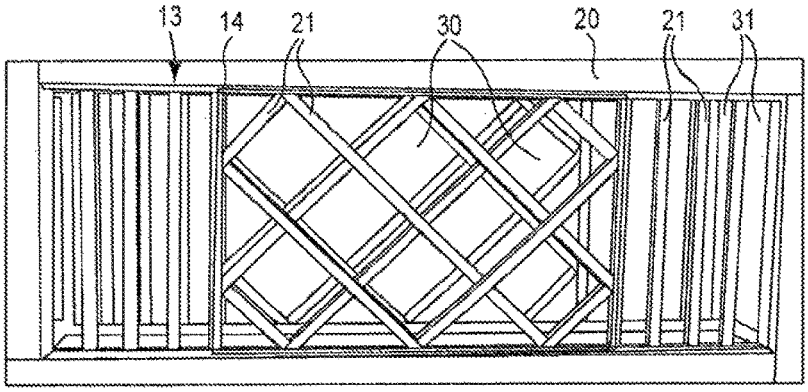
FIG. 12C is a perspective view of the example of the cabinet conversion panel in FIG. 12A. This panel is shown with the interchangeable center insert (FIG. 13A) installed. This panel is shown installed in a cabinet (20).

FIG. 12C shows an embodiment of the present invention shown in FIG. 12A wherein the panel is shown with the interchangeable center insert (FIG. 13A) installed. The panel is shown installed in a cabinet (20).

Figure 12D:
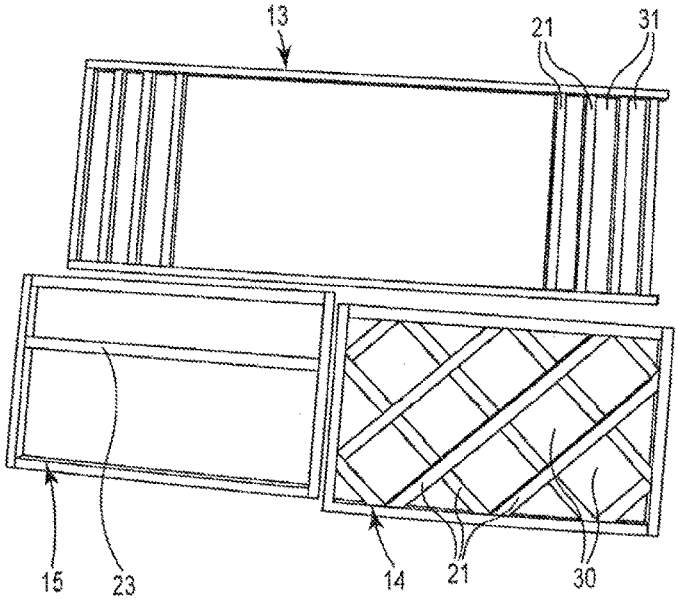
FIG. 12D is a frontal perspective view of an example of the cabinet conversion panel (FIG. 12A), the interchangeable center insert (FIG. 13A) and the interchangeable center insert (FIG. 14A-14B) in accordance with an embodiment of the present invention.
Figure 12E:
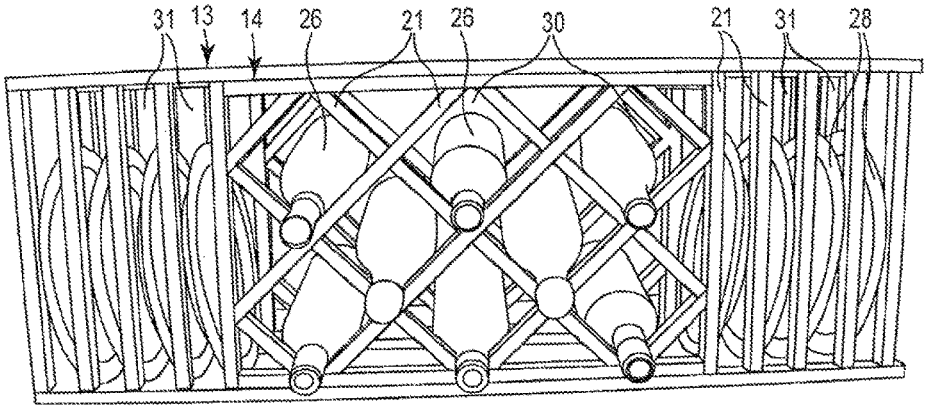
FIG. 12E is a schematic frontal perspective view of an example of the cabinet conversion panel (FIG. 12A), the interchangeable center insert (FIG. 13A-13C) and the interchangeable center insert (FIG. 14A-14B) in accordance with an embodiment of the present invention.
Figure 12F:
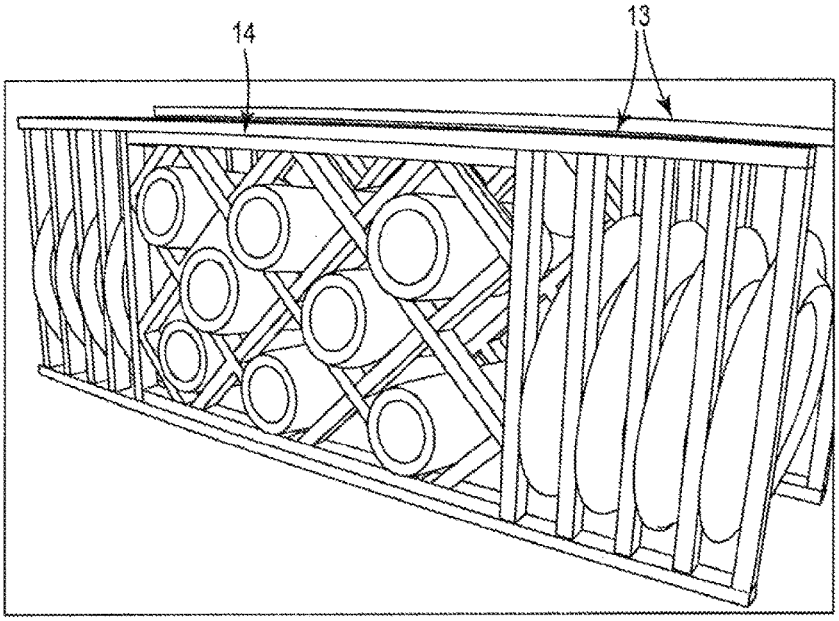
FIG. 12F is a frontal perspective view of the example of two cabinet conversion panels as shown in FIG. 12C. The cabinet conversion panels are shown with the interchangeable center inserts (FIG. 13A) installed. The cabinet conversion panels are shown as they would be spatially placed if they were inside a cabinet (20). This example shows plates (28) and wine bottles (26) stored in the cabinet conversion panels.
Figure 12G:
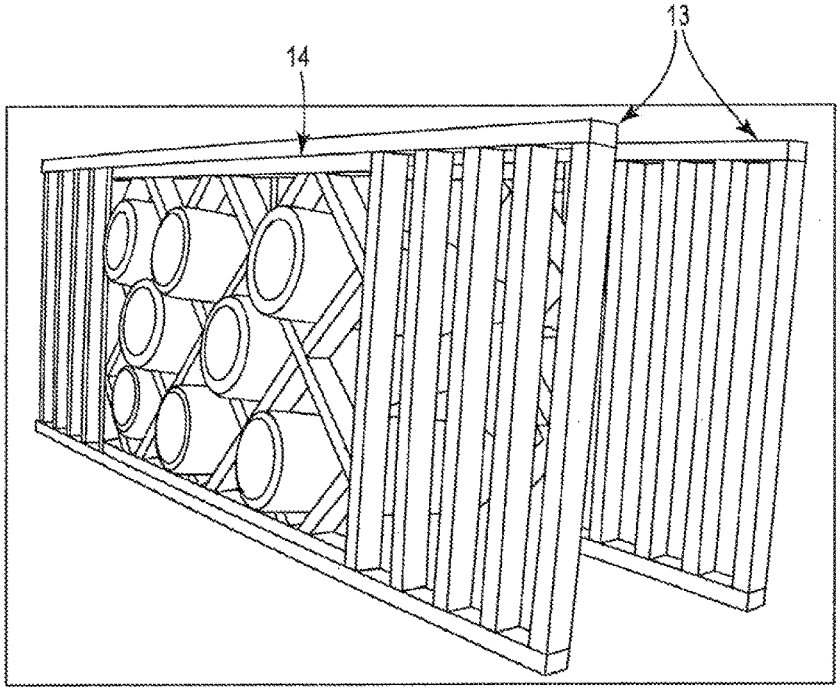
FIG. 12G is an angular front perspective view of the example of two cabinet conversion panels as shown in FIG. 12C. The cabinet conversion panels are shown with the interchangeable center inserts (FIG. 13A) installed. The cabinet conversion panels are shown as they would be spatially placed if they were inside a cabinet (20). This example shows wine bottles (26) stored in the cabinet conversion panels.
Figure 12H:
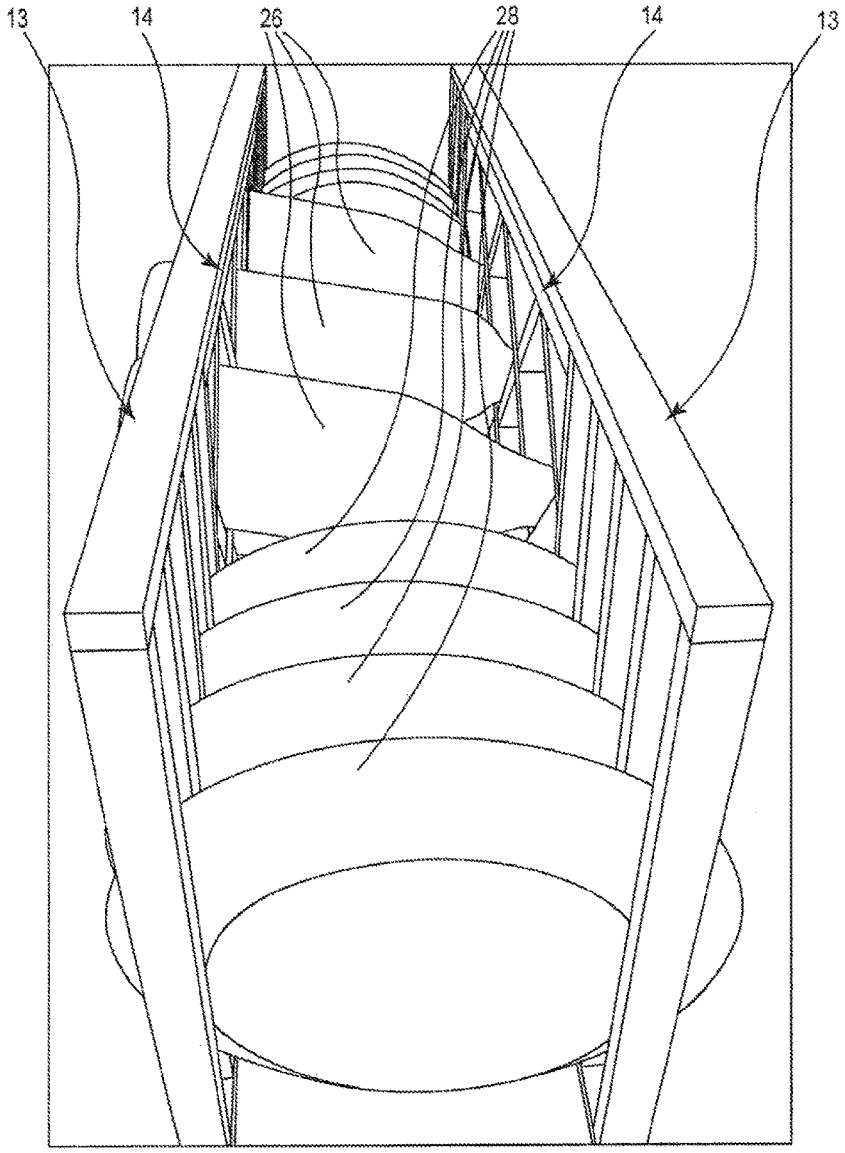
FIG. 12H is an angular top perspective view of the example of two cabinet conversion panels as shown in FIG. 12C. The cabinet conversion panels are shown with the interchangeable center inserts (FIG. 13A) installed. The cabinet conversion panels are shown as they would be spatially placed if they were inside a cabinet (20). This example shows plates (28) and wine bottles (26) stored in the cabinet conversion panels.

FIGS. 12D and 12E show an embodiment of the present invention shown in FIG. 12A along with the interchangeable center insert (FIG. 13A-13C) and the interchangeable center insert (FIG. 14A-14B), also in accordance with an embodiment of the present invention.

Figure 13A:
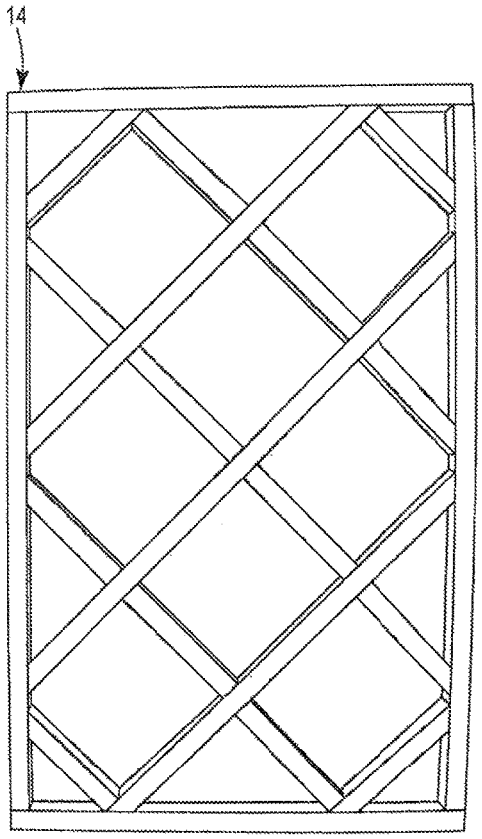
FIG. 13A is a front view of an example of an interchangeable center insert wherein posts (21) are connected and fastened in a lattice style pattern to form partitioned wine bottle openings (30).
Figure 13B:
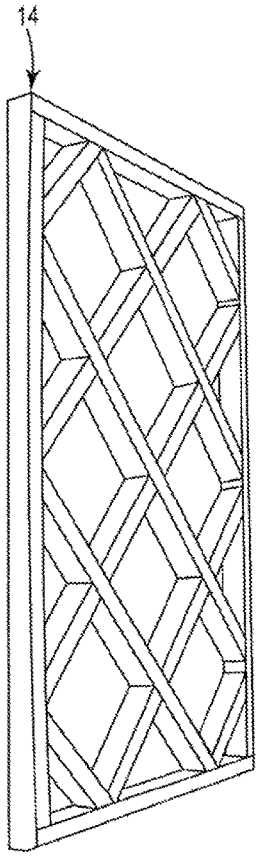
FIG. 13B is a schematic angular side perspective view of the example of the interchangeable center insert in FIG. 13A.

FIGS. 13A through 13C show an interchangeable center insert (14) wherein posts (21) are connected and fastened in a lattice style pattern to form partitioned wine bottle openings (30).

Figure 14A:
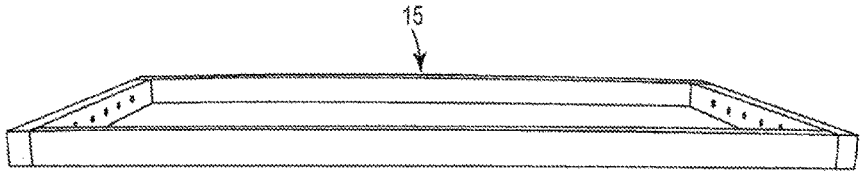
FIG. 14A is a top side perspective view of an example of an interchangeable center insert wherein the frame has shelf bracket holes (25) for the insertion of shelf brackets (24) to support adjustable shelves (23) to form partitioned openings (33) on which wine glasses (27), dishware or other items may be stored.
Figure 14B:
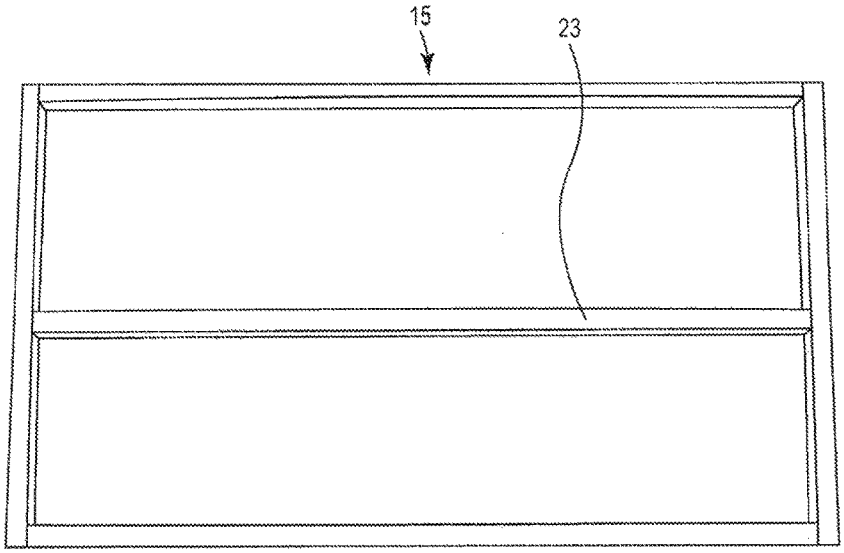
FIG. 14B is a front view of the example of the interchangeable center insert in FIG. 14A.
Figure 15:
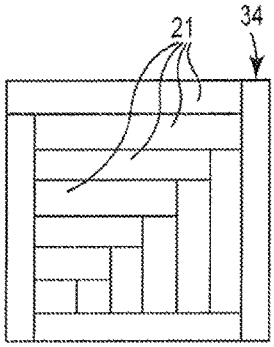
FIG. 15 is a front view of an example of an insertable coaster wherein posts are connected and fastened to form a right angle pattern.
Figure 16:
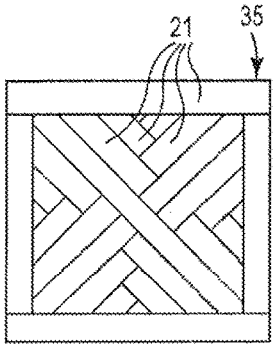
FIG. 16 is a front view of an example of a second type of insertable coaster wherein posts are connected and fastened to form an X pattern.
Figure 17:
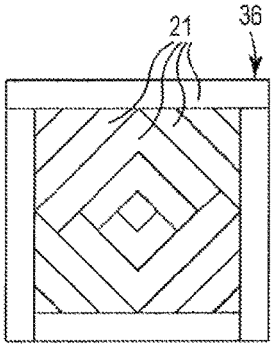
FIG. 17 is a front view of an example of a third type of insertable coaster wherein posts are connected and fastened to form a diamond pattern.
Figure 18:
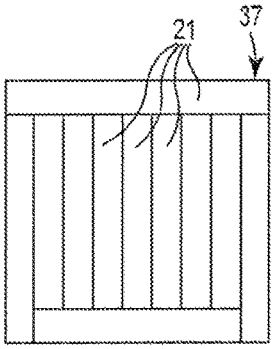
FIG. 18 is a front view of an example of a fourth type of insertable coaster wherein posts are connected and fastened to form a stripe pattern.
Figure 19:
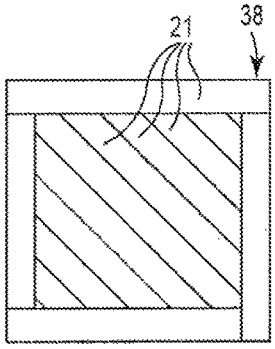
FIG. 19 is a front view of an example of a fifth type of insertable coaster wherein posts are connected and fastened to form a diagonal stripe pattern.
Figure 20:
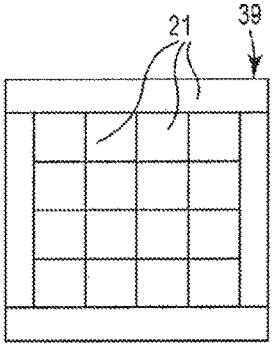
FIG. 20 is a front view of an example of a sixth type of insertable coaster wherein posts are connected and fastened to form a checkerboard pattern.
Figure 21:
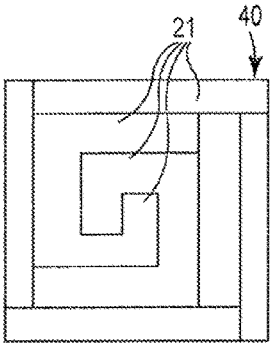
FIG. 21 is a front view of an example of a seventh type of insertable coaster wherein posts are connected and fastened to form a maze pattern.

FIGS. 14A through 14B show a second type of an interchangeable center insert (15) wherein the frame has shelf bracket holes (25) for the insertion of shelf brackets (24) to support adjustable shelves (23) to form partitioned openings (33) on which wine glasses (27), dishware or other items may be stored.

FIGS. 15 thru 22 show eight different examples of insertable coasters (34-41) comprising a plurality of posts (21) connected and fastened in geometrical patterns.

FIG. 22 is an embodiment of the present invention wherein posts (21) are connected and fastened in a herringbone style pattern.

Figure 23:
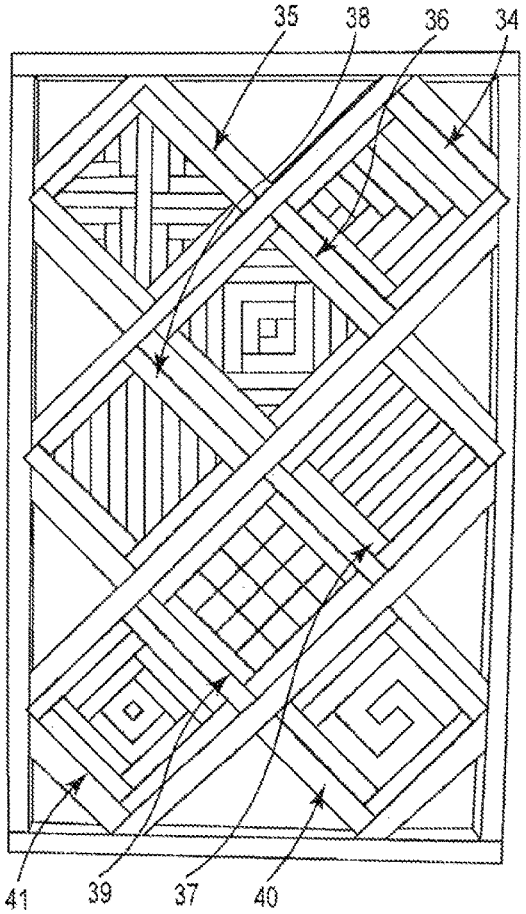
FIG. 23 shows an example of this interchangeable insert installed in the cabinet conversion panel (FIG. 6A).

FIG. 23 shows all eight examples of the insertable coasters (FIG. 15-22) installed in partitioned wine bottle storage openings.

FIG. 24 shows an embodiment of the present invention wherein posts (21) are connected and fastened in a lattice style pattern to form partitioned wine bottle openings (30).

FIG. 25 shows an embodiment of the present invention wherein posts (21) are connected and fastened in a lattice style pattern to form partitioned wine bottle openings (30). This example is distinguishable from the cabinet conversion panel in FIG. 24 as they are installed in the frame at a different attachment point causing them to have a different number of partitioned openings (30).

FIG. 26 shows an embodiment of the present invention wherein posts (21) are connected and fastened in three, four-part connected diamond style pattern to form partitioned wine bottle openings (30).

Figure 27:
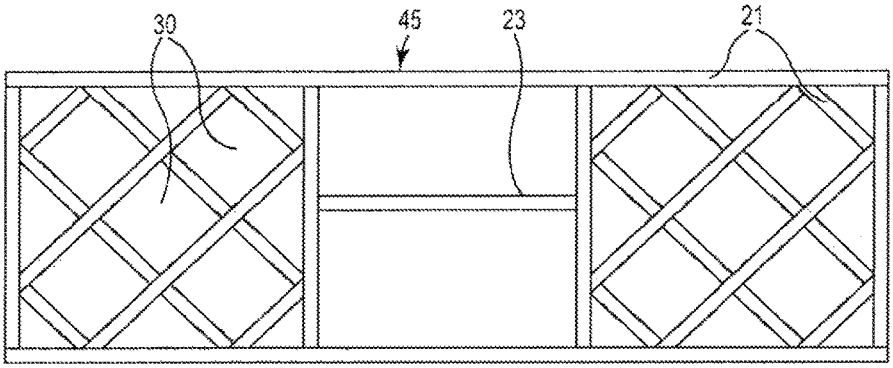
FIG. 27 is a schematic front view of an example of the cabinet conversion panel, in accordance with an embodiment of the present invention wherein the center section comprises a frame with shelf bracket holes (25) for the insertion of shelf brackets (24) to support adjustable shelves (23) to form partitioned openings (33) on which wine glasses (27), dishware or other items may be stored; and wherein the two end sections comprise posts (21) which are connected and fastened in a lattice pattern to form partitioned wine bottle openings (30).
Figure 28:
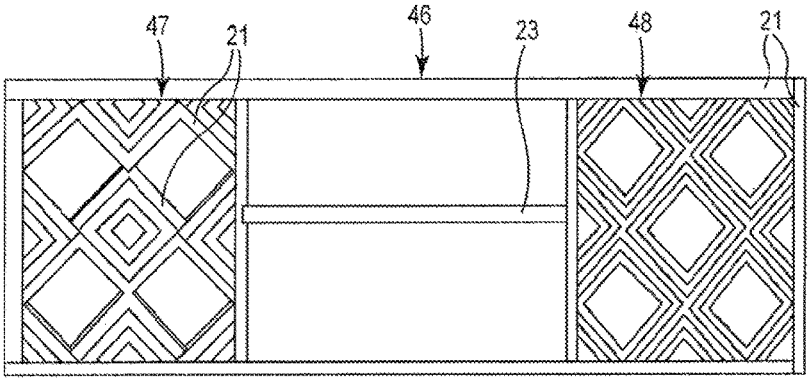
FIG. 28 is a front view of an example of the cabinet conversion panel, in accordance with an embodiment of the present invention which comprises a fixed center section frame with shelf bracket holes (25) for the insertion of shelf brackets (24) to support adjustable shelves (23) to form partitioned openings (33) on which wine glasses (27), dishware or other items may be stored; and two interchangeable end sections in which shelves (23) or interchangeable end inserts may be installed or which may be left open for general storage. In this example, one type of interchangeable end insert (FIG. 32) is installed in the left end section of the cabinet conversion panel and a different type of interchangeable end insert (FIG. 33) is installed in the right end section of the cabinet conversion panel.

FIG. 27 shows an embodiment of the present invention wherein the center section comprises posts (21) which are connected and fastened to form a frame with shelf bracket holes (25) for the insertion of shelf brackets (24) to support adjustable shelves (23) to form partitioned openings (33) on which wine glasses (27), dishware or other items may be stored; and wherein the two end sections comprise posts (21) which are connected and fastened in a lattice pattern to form partitioned wine bottle openings (30).

FIG. 28 shows an embodiment of the present invention which comprises a fixed center section frame with shelf bracket holes (25) for the insertion of shelf brackets (24) to support adjustable shelves (23) to form partitioned openings (33) on which wine glasses (27), dishware or other items may be stored; and two interchangeable end sections in which shelves (23) or interchangeable end inserts (46) may be installed or which may be left open for general storage. In this example, one type of interchangeable end insert (47) is installed in the left end section of the cabinet conversion panel and a different type of interchangeable end insert (FIG. 33) is installed in the right end section of the cabinet conversion panel.

Figure 29:
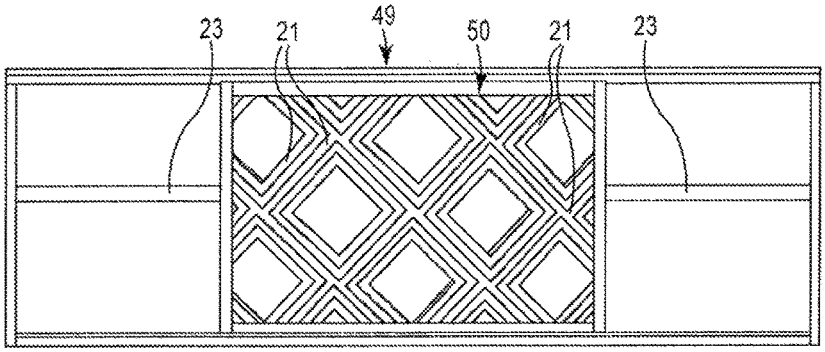
FIG. 29 is a front view of an example of the cabinet conversion panel, in accordance with an embodiment of the present invention which comprises an interchangeable center section in which shelves (23) or interchangeable center inserts may be installed or which may be left open for general storage; and two fixed end section frames with shelf bracket holes (25) for the insertion of shelf brackets (24) to support adjustable shelves (23) to form partitioned openings (33) on which wine glasses (27), dishware or other items may be stored. In this example, one type of interchangeable center insert (FIG. 31) is installed in the center section of the cabinet conversion panel.

FIG. 29 shows an embodiment of the present invention which comprises an interchangeable center section in which shelves (23) or interchangeable center inserts may be installed or which may be left open for general storage; and two fixed end section frames with shelf bracket holes (25) for the insertion of shelf brackets (24) to support adjustable shelves (23) to form partitioned openings (33) on which wine glasses (27), dishware or other items may be stored. In this example, one type of interchangeable center insert (FIG. 31) is installed in the center section of the cabinet conversion panel.

Figure 30:
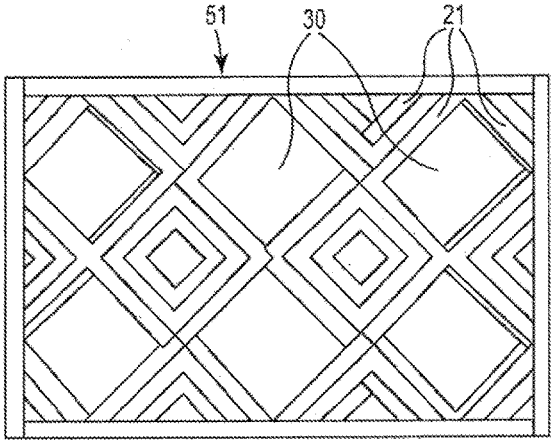
FIG. 30 is a front view of the example of the interchangeable center insert in FIG. 29.
Figure 31:
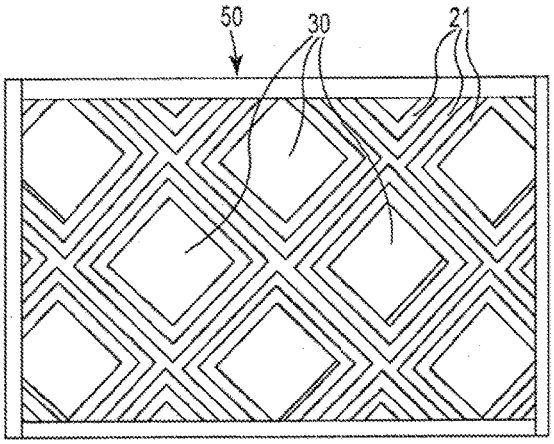
FIG. 31 is a front view of the example of the interchangeable center insert in FIG. 29.

FIGS. 30 and 31 show examples of the interchangeable center inserts.

FIGS. 32 and 33 show examples of the interchangeable end inserts.

Figure 34:
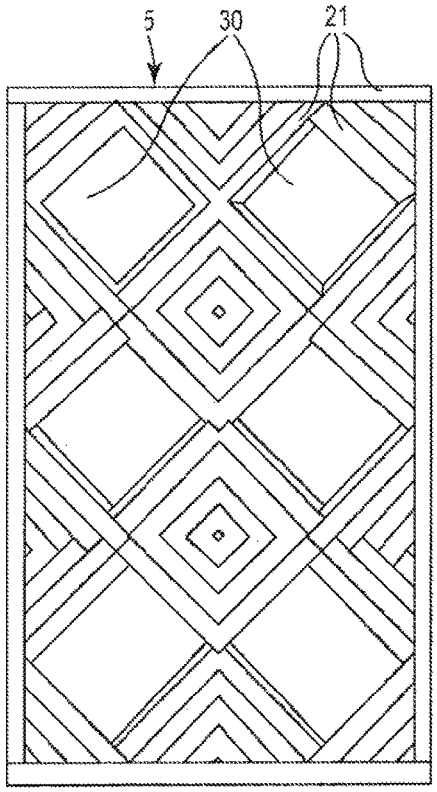
FIG. 34 is a frontal perspective view of an example of the cabinet conversion panel, in accordance with an embodiment of the present invention wherein posts (21) are connected and fastened in a herringbone pattern to form partitioned wine bottle openings (30).

FIG. 34 shows an embodiment of the cabinet conversion panel wherein posts (21) are connected and fastened in a herringbone pattern to form partitioned wine bottle openings (30).

Figure 6A:
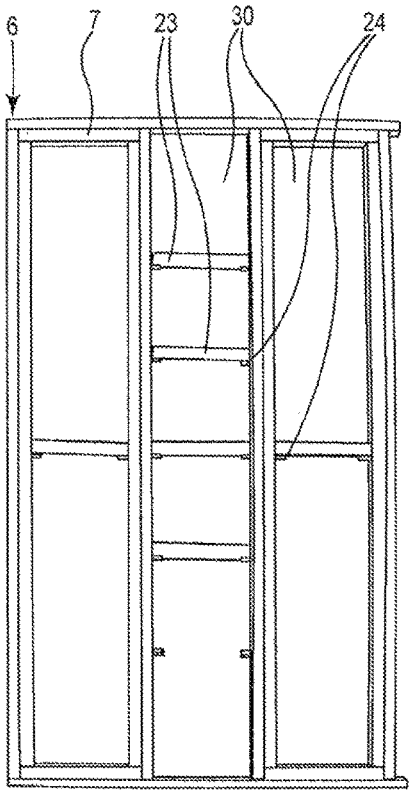
FIG. 6A is a front view of an example of the cabinet conversion panel, in accordance with an embodiment of the present invention wherein posts (21) are connected and fastened to form three interchangeable sections (30) in which wine bottles (26) may be stored. The interchangeable sections also accommodate shelves (23) as shown in FIG. 6A to FIG. 6E and interchangeable inserts as shown in FIGS. 7 and 8.
Figure 6B:
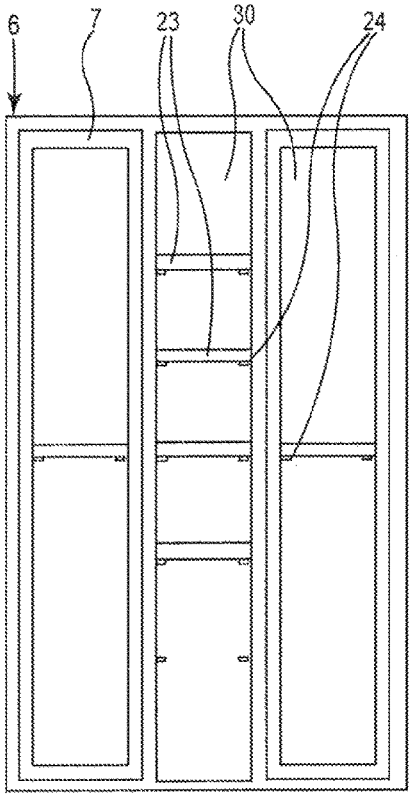
FIG. 6B is a schematic front view of an example of the cabinet conversion panel in FIG. 6A.
Figure 6C:
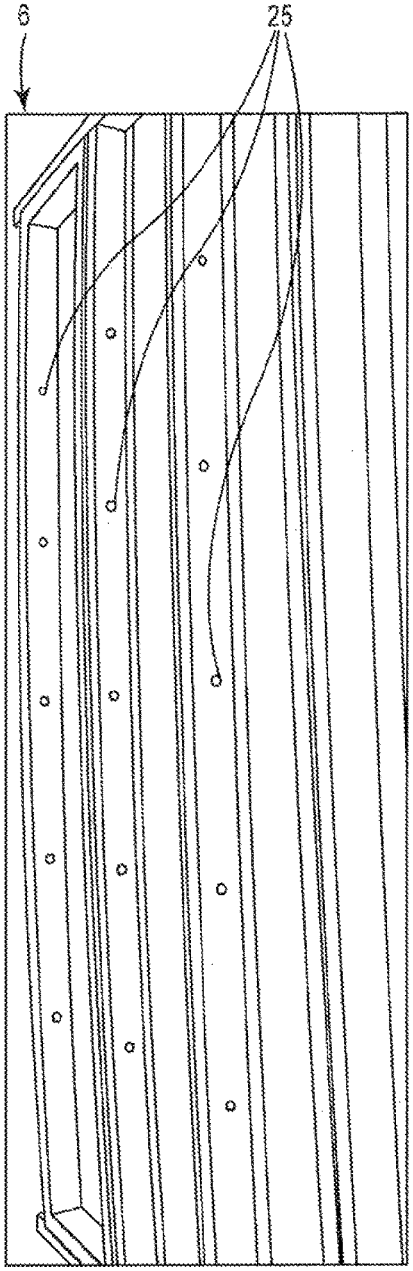
FIG. 6C is a perspective side view of an example of the cabinet conversion panel in FIG. 6A.
Figure 6D:
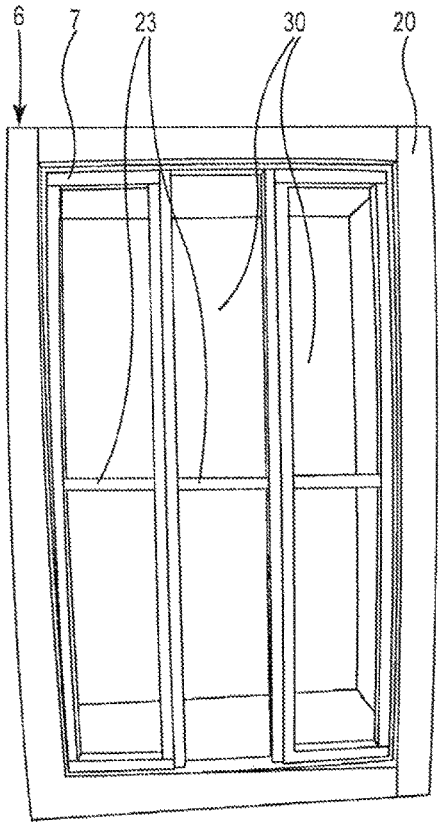
FIG. 6D is a frontal perspective view of an example of the cabinet conversion panel in FIG. 6A. This panel is shown installed in a cabinet (20).
Figure 35:
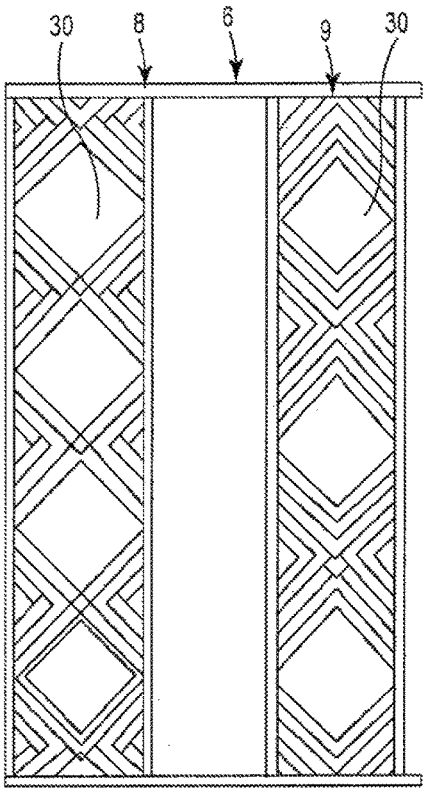
FIG. 35 is a frontal perspective view of an example of the cabinet conversion panel in FIG. 6A. This panel is shown with one type of interchangeable panel (FIG. 7) installed in the left end panel and a second type of interchangeable panel (FIG. 8) installed in the right end panel.

FIG. 35 shows an example of the cabinet conversion panel in FIG. 6A. This panel is shown with one type of interchangeable panel (FIG. 7) installed in the left end panel and a second type of interchangeable panel (FIG. 8) installed in the right end panel.

Figure 36A:
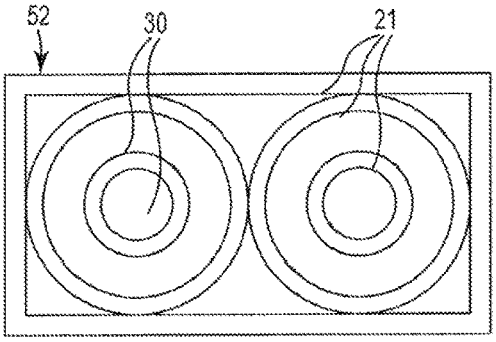
FIGS. 36A and 36B are schematic front views of an example of the cabinet conversion panel, in accordance with an embodiment of the present invention wherein posts (21) or rods (22) are connected and fastened in circular style patterns which form partitioned wine bottle openings (30).
Figure 36B:
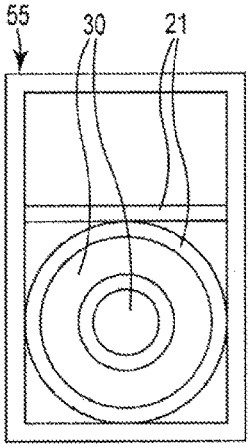

In another example (FIGS. 36A and 36B), the cabinet conversion panel comprises a plurality of posts (21) or rods (22) connected and fastened in circular style patterns which form partitioned openings (30) to accommodate the storage of wine bottles (26).

Figure 37A:
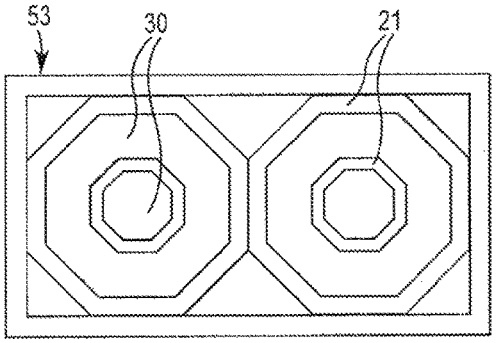
FIGS. 37A and 37B are schematic front views of an example of the cabinet conversion panel, in accordance with an embodiment of the present invention wherein posts (21) are connected and fastened in octagon style patterns which form partitioned wine bottle openings (30).
Figure 37B:
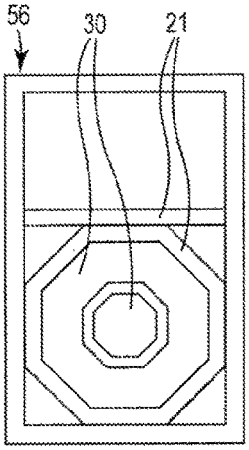
Figure 38A:
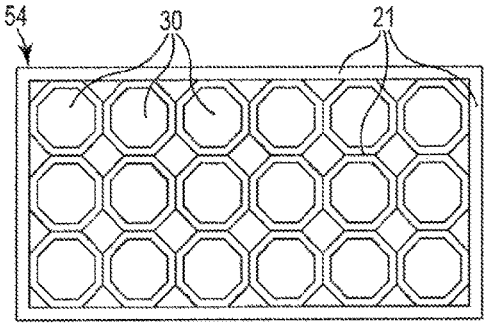
FIGS. 38A, 38B, 39, and 40 are schematic front views of examples of the cabinet conversion panel in accordance with embodiments of the present invention.
Figure 38B:
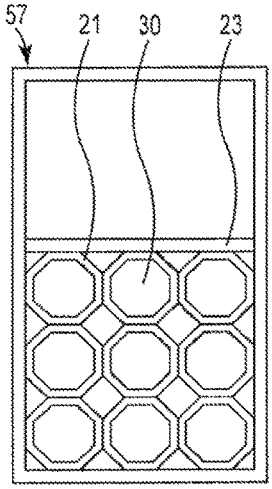
Figure 39:
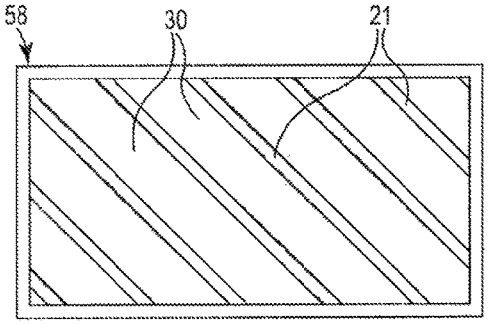
Figure 40:
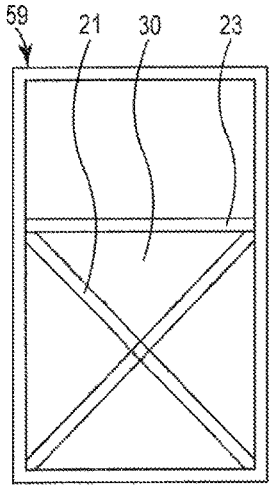
Figure 41:
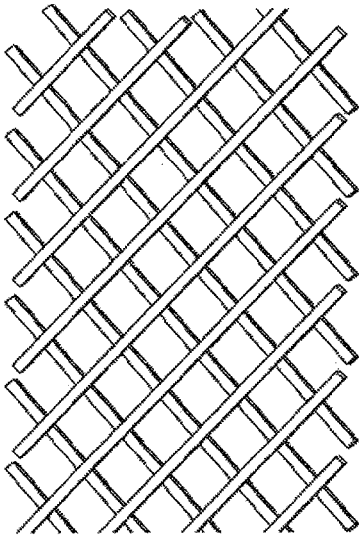
FIGS. 41-45 are views of wine bottle storage.
Figure 42:
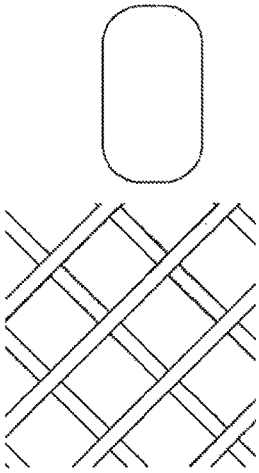
Figure 43:
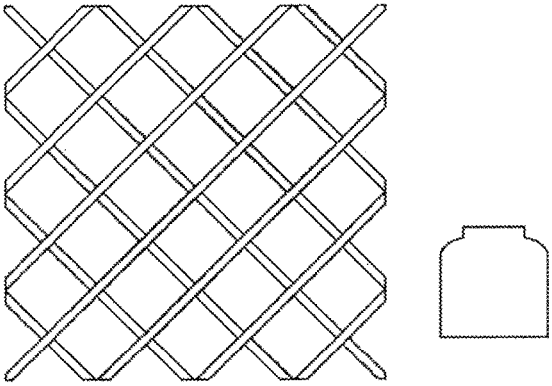
Figure 44:
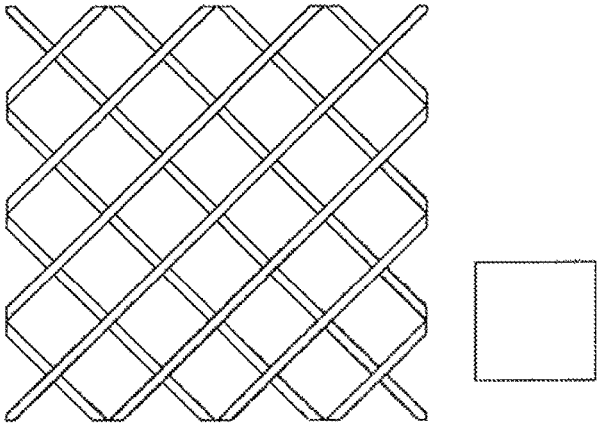
Figure 45:
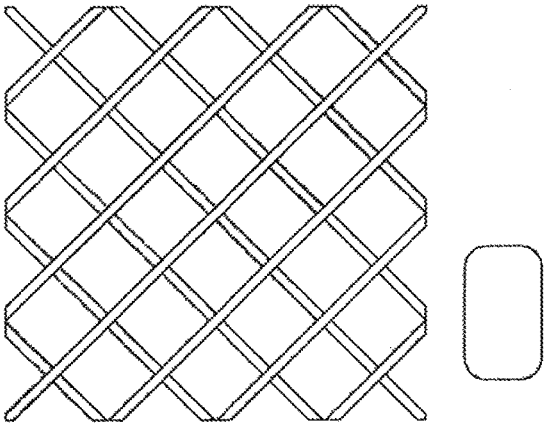
Figure 46:
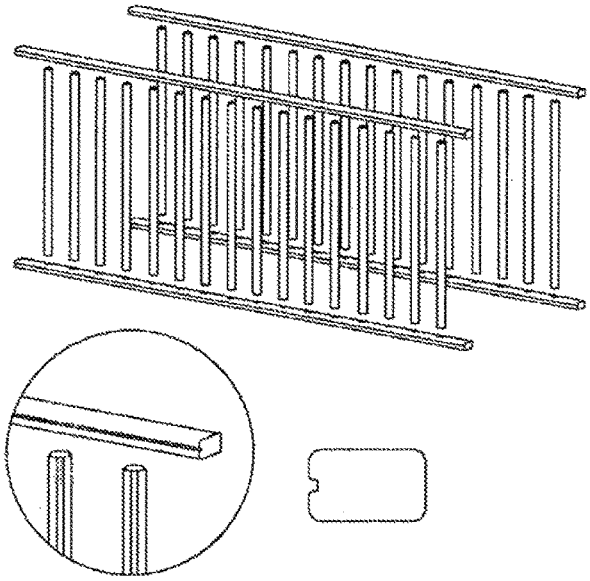
FIGS. 46-47 are views of plate racks.
Figure 47:
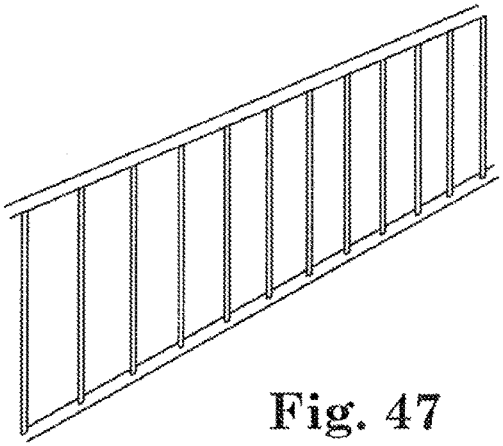
Figure 48:
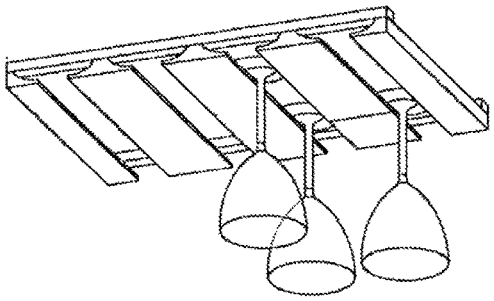
FIGS. 48-50 are views of stemware molding.
Figure 49:
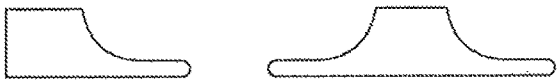
Figure 50:
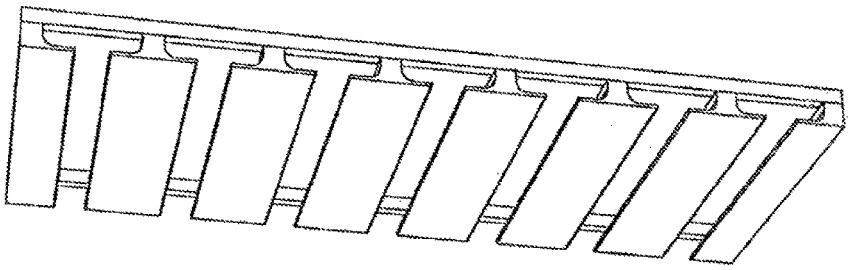

In another example (FIGS. 37A and 37B), the cabinet conversion panel comprises a plurality of posts (21) connected and fastened in octagon style patterns which form partitioned openings (30) to accommodate the storage of wine bottles (26).

In another example, the cabinet conversion panel may comprise a shelf (23) with stemware molding or hooks attached, adapted to be attached to panels, inside cabinets (20) or underneath cabinets (20).

What is claimed is:

1. A system comprising:

a cabinet having a first cabinet side wall, a second cabinet side wall, a cabinet top wall, a cabinet bottom wall and a cabinet back wall that defines a cabinet interior bounded by the first and second cabinet side walls, the cabinet top wall, the cabinet bottom wall and the cabinet back wall; and a cabinet conversion panel system comprising:

a first panel having a first frame with a first frame top, a first frame bottom, and first frame sides wherein the first frame connects to and surrounds a first plurality of rods, posts, or a combination thereof that form a first plurality of storage areas, each of the first plurality of storage areas defining an opening in the first panel, wherein the first panel is positioned in the cabinet interior of the cabinet proximate to the cabinet back wall with the first frame top proximate to an inner surface of the cabinet top wall, the first frame bottom proximate to an inner surface of the cabinet bottom wall, and the first frame sides proximate to inner surfaces of the first and second cabinet side walls; and a second panel having a second frame with a second frame top, a second frame bottom, and second frame sides wherein the second frame connects to and surrounds a second plurality of rods, posts, or a combination thereof that form a second plurality of storage areas, each of the second plurality of storage areas defining an opening in the second panel, wherein the second panel is positioned in the cabinet interior of the cabinet spaced from the first panel toward a front of the cabinet and wherein the second panel is positioned with the second frame top proximate to the inner surface of the cabinet top wall, the second frame bottom proximate to the inner surface of the cabinet bottom wall, and the second frame sides proximate to the inner surfaces of the first and second cabinet side walls; wherein the first and second panels are independently and spatially inserted into the cabinet and capable of supporting items between them.

2. The system of claim 1 wherein the openings in the first panel comprise first and second holes and the openings in the second panel comprise third and fourth holes, the system further comprising:

a first removable coaster positioned in the first hole so as to substantially fill the first hole; and a second removable coaster positioned in the second hole so as to substantially fill the second hole;

wherein the first hole, the second hole, the third hole, and fourth hole are sized and configured to hold first and second wine bottles that extend from the first and second holes to the third and fourth holes respectively when the coasters are removed from the first and second holes.

3. The system of claim 2, wherein the first removable coaster comprises a first design pattern and at least one see-through portion, wherein the second removable coaster comprises a second design pattern and at least one see-through portion, wherein the first design pattern is different than the second design pattern, and wherein the first and second coasters are suitable for interchangeably positioning in either of the first and second holes respectively.

4. The system of claim 1, wherein the openings of the first and second storage areas comprise vertically extending slots that are sized and configured for holding upright dinner plates and square spaces that are sized and configured for holding wine bottles in a horizontal orientation.

5. The system of claim 1, wherein the first plurality of rods, posts, or a combination thereof comprise a plurality of posts that are fastened together to form some of the openings that define a plurality of multilayered diagonal squares that are fastened together in an intersecting pattern.

6. The system of claim 5, wherein each of the multilayered diagonal squares has an inner surface that is sized and configured for holding a wine bottle.

7. A system comprising:

a first cabinet conversion panel comprising a first panel frame that extends substantially around a perimeter of the first cabinet conversion panel; and a first insert having a first insert frame that connects to and surrounds a first plurality of rods, posts, or a combination thereof that form a first plurality of storage areas, each of the first plurality of storage areas defining an opening in the first insert, wherein the first insert frame has a first insert frame outer surface, wherein the first panel frame has a first panel frame inner surface, wherein the openings in the first panel comprise first and second holes;

a first removable coaster positioned in the first hole so as to substantially fill the first hole;

a second removable coaster positioned in the second hole so as to substantially fill the second hole;

and wherein the first insert is installed in the first cabinet conversion panel such that the first insert frame outer surface is adjacent to the first panel frame inner surface;

wherein the first and second holes are sized and configured to hold first and second wine bottles respectively when the coasters are removed from the first and second holes.

8. The system of claim 7 wherein the first cabinet conversion panel comprises a fixed center section and defines first and second end sections on opposite sides of the fixed center section, wherein the first end section is sized and configured for receiving the first insert frame within the first panel frame and the second end section is sized and configured for receiving a second insert frame of a second insert within the first panel frame.

9. The system of claim 7 wherein the first cabinet conversion panel comprises two fixed end sections and defines a center section between the fixed end sections, wherein the center section is sized and configured for receiving the first insert frame within the first panel frame.

10. The system of claim 7 wherein the first plurality of storage areas define a repeating geometric pattern.

11. The system of claim 7, and further comprising:

a cabinet defining a cabinet interior;

a second cabinet conversion panel comprising a second panel frame that extends substantially around a perimeter of the second cabinet conversion panel; and a second insert having a second insert frame that connects to and surrounds a second plurality of rods, posts, or a combination thereof that form a second plurality of storage areas, each of the second plurality of storage areas defining an opening in the second insert, wherein the second insert frame has a second insert frame outer surface, wherein the second panel frame has a second panel frame inner surface, and wherein the second insert is installed in the second cabinet conversion panel such that the second insert frame outer surface is adjacent to the second panel frame inner surface, wherein the first and second cabinet conversion panels are positioned in the cabinet interior of the cabinet such that an outer surface of the first panel frame is adjacent an inner surface of the cabinet, an outer surface of the second panel frame is adjacent the inner surface of the cabinet, and the first and second cabinet conversion panels are spaced from each other such that the first and second inserts are also spaced from each other.

12. The system of claim 11, wherein the first insert is removable from the first cabinet conversion panel such that the first panel frame is retained with the first cabinet conversion panel and the first insert frame is retained with the first insert when the first insert is removed from the first cabinet conversion panel and wherein the second insert is removable from the second cabinet conversion panel such that the second panel frame is retained with the second cabinet conversion panel and the second insert frame is retained with the second insert when the second insert is removed from the second cabinet conversion panel.

13. The system of claim 7, wherein the first cabinet conversion panel entirely surrounds a perimeter of the first insert.

14. The system of claim 7, wherein the first cabinet conversion panel comprises a second plurality of rods, posts, or a combination thereof that form a second plurality of storage areas that are supported by and connected directly to the first panel frame without an intervening insert frame.

15. The system of claim 14, wherein the first plurality of rods, posts, or a combination thereof are oriented differently than the second plurality of rods, posts, or a combination thereof such that the first plurality of storage areas are configured to hold different items than those held by the second plurality of storage areas, with at least one of the first and second plurality of storage areas being sized and configured to hold wine bottles in a horizontal orientation.

16. The system of claim 15, wherein the other of the first and second plurality of storage areas is sized and configured to hold plates.

17. A cabinet conversion panel system comprising:

two or more separate interchangeable panels;

each panel having a frame that defines a perimeter that surrounds first, second, and third sections;

wherein the first section and the third section each have a plurality of vertical members that are fixed to the perimeter of the frame at spaced intervals, the spaced intervals each defining a vertical slot that is configured to receive a plate there through;

wherein the second section defines an opening between the first section and the third section;

an interchangeable insert that has a plurality of diagonal support members which cross each other to form generally diamond shaped spaces that are sized to receive wine bottles there through;

wherein the interchangeable insert is configured to be inserted into and removed from the opening of the second section; wherein the two or more interchangeable panels are configured to be individually and spatially inserted into a cabinet and are capable of supporting the plates and the wine bottles between them.

18. The cabinet conversion panel system of claim 17 wherein each panel further comprises removable coasters for insertion into the generally diamond shaped spaces of the interchangeable insert.

19. The cabinet conversion panel system of claim 17, wherein said vertical members are posts or rods.

20. A cabinet comprising two or more separate interchangeable panels;

each panel having a frame that defines a perimeter that surrounds first, second, and third sections;

wherein the first section and the third section each have a plurality of vertical members that are fixed to the perimeter of the frame at spaced intervals, the spaced intervals each defining a vertical slot that is configured to receive a plate there through;

wherein the second section defines an opening between the first section and the third section;

an interchangeable insert that has a plurality of diagonal support members which cross each other to form generally diamond shaped spaces that are sized to receive wine bottles there through;

wherein the interchangeable insert is configured to be inserted into and removed from the opening of the second section; wherein the two or more interchangeable panels are individually and spatially inserted into the cabinet to support the plates and the wine bottles between them.

21. The cabinet of claim 20, wherein said vertical members are posts or rods.

* * * * *